US008022358B2

(12) United States Patent
Green

(10) Patent No.: US 8,022,358 B2
(45) Date of Patent: Sep. 20, 2011

(54) MASS SPECTROMETER

(75) Inventor: Martin Green, Cheshire (GB)

(73) Assignee: Micromass UK Limited (GB)

( * ) Notice: Subject to any disclaimer, the term of this patent is extended or adjusted under 35 U.S.C. 154(b) by 378 days.

(21) Appl. No.: 12/158,603

(22) PCT Filed: Dec. 21, 2006

(86) PCT No.: PCT/GB2006/004892

§ 371 (c)(1),
(2), (4) Date: Jul. 31, 2008

(87) PCT Pub. No.: WO2007/072038

PCT Pub. Date: Jun. 28, 2007

(65) Prior Publication Data

US 2008/0302958 A1 Dec. 11, 2008

Related U.S. Application Data

(60) Provisional application No. 60/758,117, filed on Jan. 11, 2006.

(30) Foreign Application Priority Data

Dec. 22, 2005 (GB) ..... 0526043.5

(51) Int. Cl.
*H01J 49/26* (2006.01)

(52) U.S. Cl. ..... 250/282; 250/287; 250/288
(58) Field of Classification Search ..... 250/282
See application file for complete search history.

(56) References Cited

U.S. PATENT DOCUMENTS 5,783,824 A 7/1998 Baba et al.
5,847,386 A 12/1998 Thomson et al.
6,107,628 A * 8/2000 Smith et al. ..... 250/292

(Continued)

FOREIGN PATENT DOCUMENTS

GB 2418528 3/2006

(Continued)

OTHER PUBLICATIONS

Welling, et al, Ion/molecule reactions, mass spectrometry and optical spectroscopy in a linear ion trap, International Journal of Mass Spectrometry and Ion Process 172 (1998), pp. 95-114.

(Continued)

*Primary Examiner* — Phillip A Johnston
(74) *Attorney, Agent, or Firm* — Diederiks & Whitelaw, PLC

(57) ABSTRACT

An ion trap mass analyser (1) is disclosed comprising a segmented rod set. Ions are trapped radially within the mass analyser by a radial pseudo-potential well. The ions are also confined axially within the ion trap by an axial electric field. The axial electric field is substantially linear across the central section of the ion trap, but the electric field is distorted across both ends of the ion trap. A supplemental AC voltage or potential is applied to the electrodes comprising the ion trap mass analyser (1) in order to excite resonantly ions within the ion trap (1). The distortions in the electric field at the ends of the ion trap cause the resonant frequency of ions within the ion trap to shift to either a higher or lower frequency. If the frequency of the supplemental AC voltage or potential is scanned appropriately then ions are ejected from the ion trap in a shorter period of time leading to an improvement in mass resolution.

19 Claims, 24 Drawing Sheets

U.S. PATENT DOCUMENTS

| | | | | |
|---|---|---|---|---|
| 6,111,250 | A * | 8/2000 | Thomson et al. | 250/282 |
| 6,791,078 | B2 * | 9/2004 | Giles et al. | 250/286 |
| 6,992,283 | B2 * | 1/2006 | Bateman et al. | 250/287 |
| 7,456,396 | B2 * | 11/2008 | Quarmby et al. | 250/292 |
| 2005/0127290 | A1 | 6/2005 | Hashimoto et al. | |

FOREIGN PATENT DOCUMENTS

| | | |
|---|---|---|
| GB | 2423864 | 9/2006 |
| WO | 2006075182 | 7/2006 |
| WO | 2007060436 | 5/2007 |

OTHER PUBLICATIONS

Hashimoto, et al, Mass Selective Ejection by Axial Resonant Excitation from a Linear Ion Trap, American Society of Mass Spectrometry, Elsevier Science Inc, US, vol. 17, No. 5, May 2006, pp. 685-690.

Collins, et al, Observation of Higher Order Quadrupole Excitation Frequencies in a Linear Ion Trap, Journal of American Society for Mass Spectrometry, vol. 11, No. 11 2000, pp. 1016-1022, Elsevier Science Inc.

* cited by examiner

MASS SPECTROMETER

CROSS REFERENCE TO RELATED APPLICATIONS

This application is the National Stage of International Application No. PCT/GB2006/004892, filed on Dec. 21, 2006, which claims priority to and benefit of U.S. Provisional Patent Application Ser. No. 60/758,117, filed on Jan. 11, 2006, and priority to and benefit of United Kingdom Patent Application No. 0526043.5, filed Dec. 22, 2005. The entire contents of these applications are incorporated herein by reference.

BACKGROUND OF THE INVENTION

1. Field of the Invention

The present invention relates to a mass spectrometer and a method of mass spectrometry.

2. Discussion of the Prior Art

U.S. Pat. No. 5,783,824 discloses a linear ion trap wherein a quadratic DC or electrostatic potential is maintained along the axial length of the ion trap. Ions are ejected from the linear ion trap in an axial direction by resonantly exciting the ions. Ions having a particular mass to charge ratio are resonantly excited by applying of a supplemental axial AC voltage waveform to the ion trap. If the supplemental axial AC voltage waveform which is applied to the ion trap is at the fundamental or harmonic frequency of ions within the ion trap then these ions will then be ejected from the ion trap.

Considering the pseudo-potential well approximation of Dehmelt, ion motion within an ion trap may be approximated as the combination of small amplitude relatively high frequency micro-motion and a lower frequency secular motion at a frequency proportional to the inverse of the mass to charge ratio of the ion. Resonance ejection may be achieved by applying a supplemental AC voltage waveform which matches the secular frequency of an ion having a mass to charge ratio which is desired to be ejected from the ion trap.

As the frequency of the supplemental AC excitation voltage approaches the frequency of the secular motion then the amplitude of ion oscillation will increase. The amplitude of ion oscillation will continue to increase until the amplitude of oscillation is such that the ion exceeds the boundaries of the ion trap and hence is ejected from the ion trap.

SUMMARY OF THE INVENTION

It is desired to provide an improved ion trap.

According to an aspect of the present invention there is provided an ion guide or ion trap comprising:

a plurality of electrodes;

AC or RF voltage means arranged and adapted to apply an AC or RF voltage to at least some of the plurality of electrodes in order to confine at least some ions radially within the ion guide or ion trap;

first means arranged and adapted to maintains a DC or electrostatic electric field across at least a portion of the axial length of the ion guide or ion trap in order to confine at least some ions axially within an axial ion trapping region of the ion guide or ion trap, wherein the DC or electrostatic electric field is substantially linear across a first portion of the axial ion trapping region and is substantially non-linear across one or more second portions of the axial ion trapping region; and second means arranged and adapted to apply a supplemental AC voltage or potential to the electrodes in a first mode of operation in order to resonantly and/or parametrically eject at least some ions from the ion guide or ion trap.

The ion trap or ion guide preferably comprises a linear ion trap or ion guide.

The first means is preferably arranged and adapted to create one or more DC, real or static potential wells having a depth selected from the group consisting of: (i) <10 V; (ii) 10-20 V; (iii) 20-30 V; (iv) 30-40 V; (v) 40-50 V; (vi) 50-60 V; (vii) 60-70 V; (viii) 70-80 V; (ix) 80-90 V; (x) 90-100 V; and (xi) >100 V.

The first means is preferably arranged and adapted to create a DC, real or static potential well having a minimum located at a first position along the axial length of the ion guide or ion trap. The ion guide or ion trap preferably has an ion entrance and an ion exit, and wherein the first position is located at a distance L downstream of the ion entrance and/or at a distance L upstream of the ion exit, and wherein L is selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

The first portion preferably extends across a middle or central section of the axial ion trapping region. The first portion preferably extends across at least 1%, 5%, 10%, 15%, 20%, 25%, 30%, 35%, 40%, 45%, 50%, 55%, 60%, 65%, 70%, 75%, 80%, 85%, 90% or 95% of the axial ion trapping region.

The axial ion trapping region preferably has a length 2L and wherein the first portion extends at least a distance $l_1$ from or about the centre of the axial ion trapping region, wherein $l_1$ is selected from the group consisting of: (i) ±0.05 L; (ii) ±0.10 L; (iii) ±0.15 L; (iv) ±0.20 L; (v) ±0.25 L; (vi) ±0.30 L; (vii) ±0.35 L; (viii) ±0.40 L; (ix) ±0.45 L; (x) ±0.50 L; (xi) ±0.55 L; (xii) ±0.60 L; (xiii) ±0.65 L; (xiv) ±0.70 L; (xv) ±0.75 L; (xvi) ±0.80 L; (xvii) ±0.85 L; (xix) ±0.90 L; and (xx) ±0.95 L.

The one or more second portions preferably extend across one or both ends of the axial ion trapping region.

The second portion preferably extends across at least 1%, 5%, 10%, 15%, 20%, 25%, 30%, 35%, 40%, 45% or 50% of the axial ion trapping region. The ion guide or ion trap preferably has a length 2L and wherein the second portion extends at least a distance $l_2$ from one or both ends of the axial ion trapping region, wherein $l_2$ is selected from the group consisting of: (i) 0.05 L; (ii) 0.10 L; (iii) 0.15 L; (iv) 0.20 L; (v) 0.25 L; (vi) 0.30 L; (vii) 0.35 L; (viii) 0.40 L; (ix) 0.45 L; and (x) 0.50 L.

According to the preferred embodiment the second means is preferably arranged and adapted to excite ions in resonant manner and/or to cause certain ions to be axially and/or radially ejected from the ion guide or ion trap. The second means is preferably arranged and adapted to apply a supplemental AC voltage or potential having a frequency $\sigma$ which is equal to $\omega$, wherein $\omega$ is the fundamental or resonance frequency of ions.

According to an alternative embodiment the second means may be arranged and adapted to excite ions in a parametric manner and/or to cause certain ions to be axially and/or radially ejected from the ion guide or ion trap. According to this embodiment the second means is arranged and adapted to apply a supplemental AC voltage or potential having a frequency a which is equal to $2\omega$, $0.667\omega$, $0.5\omega$, $0.4\omega$, $0.33\omega$, $0.28\omega$ or $0.25\omega$, wherein $\omega$ is the fundamental or resonance frequency of ions.

The first means is preferably arranged and adapted to maintain at least 1, 2, 3, 4, 5, 6, 7, 8, 9, 10 or >10 DC, real or static potential wells along the axial length of the ion guide or ion trap.

The first means preferably comprises one or more DC voltage supplies for supplying one or more DC voltages to at least 1%, 5%, 10%, 20%, 30%, 40%, 50%, 60%, 70%, 80%, 90%, 95% or 100% of the electrodes.

The first means is preferably arranged and adapted to provide an electric field having an electric field strength which varies or increases along at least 1%, 5%, 10%, 20%, 30%, 40%, 50%, 60%, 70%, 80%, 90%, 95% or 100% of the axial length of the ion guide or ion trap.

The second means is preferably arranged and adapted to maintain or apply the supplemental AC voltage or potential along at least 1%, 5%, 10%, 20%, 30%, 40%, 50%, 60%, 70%, 80%, 90%, 95% or 100% of the axial length of the ion guide or ion trap.

According to the preferred embodiment the second means is arranged and adapted in the first mode of operation to generate an axial electric field which has a substantially linear electric field strength along at least a portion of the axial length of the ion guide or ion trap at any point in time.

The second means is preferably arranged and adapted in the first mode of operation to generate an axial electric field which has a substantially linear electric field strength along at least 1%, 5%, 10%, 20%, 30%, 40%, 50%, 60%, 70%, 80%, 90%, 95% or 100% of the axial length of the ion guide or ion trap at any point in time.

The second means is preferably arranged and adapted in the first mode of operation to generate an axial electric field which has an electric field strength which varies with time.

According to the preferred embodiment the ion trap or ion guide preferably further comprises means arranged and adapted in a mode of operation to eject at least some ions from one or more DC, real or static potential wells within the ion guide or ion trap whilst other ions are arranged to remain substantially trapped within the one or more DC, real or static potential wells.

According to another embodiment the ion trap or ion guide further comprises means arranged and adapted to alter and/or vary and/or scan the amplitude of the supplemental AC voltage or potential. The means is preferably arranged and adapted to increase or decrease the amplitude of the supplemental AC voltage or potential.

According to an embodiment the means is arranged and adapted to increase or decrease the amplitude of the supplemental AC voltage or potential in a substantially continuous and/or linear and/or progressive and/or regular manner. According to another embodiment the means is arranged and adapted to increase or decrease the amplitude of the supplemental AC voltage or potential in a substantially non-continuous and/or non-linear and/or non-progressive and/or irregular manner.

The means is preferably arranged to vary the amplitude of the supplemental AC voltage or potential by $x_1$ Volts over a time period of $t_1$ seconds. Preferably, $x_1$ is selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1-2; (xii) 2-3; (xiii) 3-4; (xiv) 4-5; (xv) 5-6; (xvi) 6-7; (xvii) 7-8; (xviii) 8-9; (xix) 9-10; and (xx) >10. Preferably, $t_1$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; and (xiii) >20.

According to another embodiment the ion guide or ion trap preferably further comprises means arranged and adapted to alter and/or vary and/or scan the frequency of oscillation or modulation of the supplemental AC voltage or potential. The means is preferably arranged and adapted to increase or decrease the frequency of oscillation or modulation of the supplemental AC voltage or potential.

According to an embodiment the means is arranged and adapted to increase or decrease the frequency of oscillation or modulation of the supplemental AC voltage or potential in a substantially continuous and/or linear and/or progressive and/or regular manner. According to another embodiment the means is arranged and adapted to increase or decrease the frequency of oscillation or modulation of the supplemental AC voltage or potential in a substantially non-continuous and/or non-linear and/or non-progressive and/or irregular manner.

According to an embodiment the means is arranged to vary the frequency of oscillation or modulation of the supplemental AC voltage or potential by $f_1$ kHz over a time period of $t_2$ seconds. Preferably, $f_1$ is selected from the group consisting of: (i) <5; (ii) 5-10; (iii) 10-15; (iv) 15-20; (v) 20-25; (vi) 25-30; (vi) 30-35; (vii) 35-40; (viii) 40-45; (ix) 45-50; (x) 50-55; (xi) 55-60; (xii) 60-65; (xiii) 65-70; (xiv) 70-75; (xv) 75-80; (xvi) 80-85; (xvii) 85-90; (xviii) 90-95; (xix) 95-100; and (xx) >100. Preferably, $t_2$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; and (xiii) >20.

The ion guide or ion trap preferably further comprises means arranged and adapted to alter and/or vary and/or scan the amplitude or depth of the one or more DC, real or static potential wells. The means is preferably arranged and adapted to increase or decrease the amplitude or depth of the one or more DC, real or static potential wells.

According to an embodiment the means is arranged and adapted to increase or decrease the amplitude or depth of the one or more DC, real or static potential wells in a substantially continuous and/or linear and/or progressive and/or regular manner. According to another embodiment the means is arranged and adapted to increase or decrease the amplitude or depth of the one or more DC, real or static potential wells in a substantially non-continuous and/or non-linear and/or non-progressive and/or irregular manner.

According to an embodiment the means is preferably arranged to vary the amplitude of the one or more DC, real or static potential wells by $x_2$ Volts over a time period of $t_3$ seconds. Preferably, $x_2$ is selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1-2; (xii) 2-3; (xiii) 3-4; (xiv) 4-5; (xv) 5-6; (xvi) 6-7; (xvii) 7-8; (xviii) 8-9; (xix) 9-10; and (xx) >10. Preferably, $t_3$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; and (xiii) >20.

The ion guide or ion trap preferably comprises means arranged and adapted to mass selectively eject ions from the ion guide or ion trap.

The AC or RF voltage means is preferably arranged and adapted to apply an AC or RF voltage to at least 1%, 5%, 10%, 20%, 30%, 40%, 50%, 60%, 70%, 80%, 90%, 95% or 100% of the plurality of electrodes. The AC or RF voltage means is preferably arranged and adapted to supply an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. The AC or RF voltage means is preferably arranged and adapted to supply an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment the ion guide or ion trap preferably comprises a multipole rod set ion guide or ion trap. For example, the ion guide or ion trap may comprise a quadrupole, hexapole, octapole or higher order multipole rod set. The plurality of electrodes preferably have a cross-section selected from the group consisting of: (i) approximately or substantially circular; (ii) approximately or substantially hyperbolic; (iii) approximately or substantially arcuate or part-circular; (iv) approximately or substantially semi-circular; and (v) approximately or substantially rectangular or square.

According to an embodiment a radius inscribed by the multipole rod set ion guide or ion trap is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The ion guide or ion trap is preferably segmented axially or preferably comprises a plurality of axial segments. For example, the ion guide or ion trap comprises x axial segments, wherein x is selected from the group consisting of: (i) <10; (ii) 10-20; (iii) 20-30; (iv) 30-40; (v) 40-50; (vi) 50-60; (vii) 60-70; (viii) 70-80; (ix) 80-90; (x) 90-100; and (xi) >100. Each axial segment preferably comprises 1, 2, 3, 4, 5, 6, 7, 8, 9, 10, 11, 12, 13, 14, 15, 16, 17, 18, 19, 20 or >20 electrodes.

The axial length of at least 1%, 5%, 10%, 20%, 30%, 40%, 50%, 60%, 70%, 80%, 90%, 95% or 100% of the axial segments is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The spacing between at least 1%, 5%, 10%, 20%, 30%, 40%, 50%, 60%, 70%, 80%, 90%, 95% or 100% of the axial segments is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The ion guide or ion trap preferably comprises a plurality of non-conducting, insulating or ceramic rods, projections or devices. For example, the ion guide or ion trap may comprise 1, 2, 3, 4, 5, 6, 7, 8, 9, 10, 11, 12, 13, 14, 15, 16, 17, 18, 19, or >20 rods, projections or devices. The plurality of non-conducting, insulating or ceramic rods, projections or devices preferably further comprise one or more resistive or conducting coatings, layers, electrodes, films or surfaces disposed on, around, adjacent, over or in close proximity to the rods, projections of devices.

According to another embodiment the ion guide or ion trap may comprise a plurality of electrodes having apertures wherein ions are transmitted, in use, through the apertures. At least 1%, 5%, 10%, 20%, 30%, 40%, 50%, 60%, 70%, 80%, 90%, 95% or 100% of the electrodes preferably have apertures which are substantially the same size or which have substantially the same area. Preferably, at least 1%, 5%, 10%, 20%, 30%, 40%, 50%, 60%, 70%, 80%, 90%, 95% or 100% of the electrodes have apertures which become progressively larger and/or smaller in size or in area in a direction along the axis of the ion guide or ion trap.

According to an embodiment at least 1%, 5%, 10%, 20%, 30%, 40%, 50%, 60%, 70%, 80%, 90%, 95% or 100% of the electrodes have apertures having internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) ≦6.0 mm; (vii) ≦7.0 mm; (viii) ≦8.0 mm; (ix) ≦9.0 mm; (x) ≦10.0 mm; and (xi) >10.0 mm.

According to another embodiment the ion guide or ion trap may comprise a plurality of plate or mesh electrodes and wherein at least some of the electrodes are arranged generally in the plane in which ions travel in use. The ion guide or ion trap may comprise a plurality of plate or mesh electrodes and wherein at least 50%, 55%, 60%, 65%, 70%, 75%, 80%, 85%, 90%, 95% or 100% of the electrodes are arranged generally in the plane in which ions travel in use. For example, the ion guide or ion trap may comprise at least 2, 3, 4, 5, 6, 7, 8, 9, 10, 11, 12, 13, 14, 15, 16, 17, 18, 19, 20 or >20 plate or mesh electrodes.

According to an embodiment adjacent plate or mesh electrodes are preferably supplied with opposite phases of an AC or RF voltage.

According to an embodiment the ion guide or ion trap may comprise 1, 2, 3, 4, 5, 6, 7, 8, 9, 10 or >10 electrodes. According to another embodiment the ion guide or ion trap may comprise at least: (i) 10-20 electrodes; (ii) 20-30 electrodes; (iii) 30-40 electrodes; (iv) 40-50 electrodes; (v) 50-60 electrodes; (vi) 60-70 electrodes; (vii) 70-80 electrodes; (viii) 80-90 electrodes; (ix) 90-100 electrodes; (x) 100-110 electrodes; (xi) 110-120 electrodes; (xii) 120-130 electrodes; (xiii) 130-140 electrodes; (xiv) 140-150 electrodes; or (xv) >150 electrodes.

The ion guide or ion trap preferably has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

The ion guide or ion trap preferably further comprises means arranged and adapted to maintain in a mode of operation the ion guide or ion trap at a pressure selected from the group consisting of: (i) $<1.0\times10^{-1}$ mbar; (ii) $<1.0\times10^{-2}$ mbar; (iii) $<1.0\times10^{-3}$ mbar; (iv) $<1.0\times10^{-4}$ mbar; (v) $<1.0\times10^{-5}$ mbar; (vi) $<1.0\times10^{-6}$ mbar; (vii) $<1.0\times10^{-7}$ mbar; (viii) $<1.0\times10^{-8}$ mbar; (ix) $<1.0\times10^{-9}$ mbar; (x) $<1.0\times10^{-10}$ mbar; and (xi) $<1.0\times10^{-11}$ mbar.

The ion guide or ion trap preferably further comprises means arranged and adapted to maintain in a mode of operation the ion guide or ion trap at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-3}$-$10^{-2}$ mbar; and (x) $10^{-4}$-$10^{-1}$ mbar.

Ions are preferably arranged to be trapped or axially confined within an axial ion trapping region within the ion guide or ion trap, the axial ion trapping region having a length l, wherein l is selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

In a mode of operation at least some ions are preferably axially and/or radially ejected from the ion guide or ion trap whilst at least some other ions remain trapped within the ion guide or ion trap prior to the second means applying a supplemental AC voltage or potential to the electrodes in order to resonantly and/or parametrically excite at least some ions.

In a mode of operation at least some ions preferably escape from the ion guide or ion trap as ions enter the ion guide or ion trap and wherein at least some other ions become trapped within the ion guide or ion trap.

In a mode of operation ions are preferably trapped but are not substantially fragmented within the ion guide or ion trap.

The ion guide or ion trap may further comprise means arranged and adapted to collisionally cool or substantially thermalise ions within the ion guide or ion trap in a mode of operation. The means arranged and adapted to collisionally cool or thermalise ions within the ion guide or ion trap is preferably arranged to collisionally cool or to substantially thermalise ions prior to and/or subsequent to at least some ions being excited parametrically and/or ejected from the ion guide or ion trap.

The ion guide or ion trap preferably further comprises fragmentation means arranged and adapted to substantially fragment ions within the ion guide or ion trap in a mode of operation. The fragmentation means is preferably arranged and adapted to fragment ions by Collisional Induced Dissociation, Surface Induced Dissociation, Electron Capture Dissociation or Electron Transfer Dissociation in a mode of operation.

The ion guide or ion trap preferably further comprises means arranged and adapted to excite parametrically at least some ions at substantially the same time as resonantly exciting at least some ions.

In a second mode of operation ions are preferably resonantly and/or mass selectively ejected axially and/or radially from the ion guide or ion trap. The ion guide or ion trap preferably further comprises means arranged and adapted in the second mode of operation to adjust the frequency and/or amplitude of an AC or RF voltage applied to the electrodes in order to eject ions by mass selective instability.

The ion guide or ion trap preferably further comprises means arranged and adapted in the second mode of operation to superimpose an AC or RF supplementary waveform or voltage to the plurality of electrodes in order to eject ions by resonance ejection.

The ion guide or ion trap preferably further comprises means arranged and adapted in the second mode of operation to apply a DC bias voltage to the plurality of electrodes in order to eject ions.

In a further mode of operation the ion guide or ion trap is, preferably arranged to transmit ions or store ions without the ions being mass selectively and/or resonantly ejected and/or parametrically ejected from the ion guide or ion trap.

In a further mode of operation the ion guide or ion trap is preferably arranged to mass filter or mass analyse ions.

In a further mode of operation the ion guide or ion trap is preferably arranged to act as a collision, fragmentation or reaction device without ions being mass selectively and/or resonantly ejected and/or parametrically ejected from the ion guide or ion trap.

The ion guide or ion trap preferably further comprises means arranged and adapted to store or trap ions within the ion guide or ion trap in a mode of operation at one or more positions which are closest to the entrance and/or centre and/or exit of the ion guide or ion trap.

The ion guide or ion trap preferably further comprises means arranged and adapted to trap ions within the ion guide or ion trap in a mode of operation and to progressively move the ions towards the entrance and/or centre and/or exit of the ion guide or ion trap.

The ion guide or ion trap preferably further comprises means arranged and adapted to apply one or more transient DC voltages or one or more transient DC voltage waveforms to the electrodes initially at a first axial position, wherein the one or more transient DC voltages or one or more transient DC voltage waveforms are then subsequently provided at second, then third different axial positions along the ion guide or ion trap.

According to an embodiment the ion guide or ion trap further comprises means arranged and adapted to apply, move or translate one or more transient DC voltages or one or more transient DC voltage waveforms from one end of the ion guide or ion trap to another end of the ion guide or ion trap in order to urge ions along at least a portion of the axial length of the ion guide or ion trap.

The one or more transient DC voltages preferably create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage waveforms preferably comprise a repeating waveform or square wave.

According to an embodiment the ion guide or ion trap preferably further comprises means arranged to apply one or more trapping electrostatic or DC potentials at a first end and/or a second end of the ion guide or ion trap.

The ion guide or ion trap may further comprise means arranged to apply one or more trapping electrostatic potentials along the axial length of the ion guide or ion trap.

According to another aspect of the present invention there is provided a mass spectrometer comprising an ion guide or an ion trap as discussed above.

The mass spectrometer preferably further comprising an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("E") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

The ion source may comprise a continuous or pulsed ion source.

The mass spectrometer preferably further comprises one or more further ion guides or ion traps arranged upstream and/or downstream of the preferred ion guide or ion trap. The one or more further ion guides or ion traps are preferably arranged and adapted to collisionally cool or to substantially thermalise ions within the one or more further ion guides or ion traps.

The one or more further ion guides or ion traps are preferably arranged and adapted to collisionally cool or to substantially thermalise ions within the one or more further ion guides or ion traps prior to and/or subsequent to ions being introduced into the preferred ion guide or ion trap.

The mass spectrometer preferably further comprises means arranged and adapted to introduce, axially inject or eject, radially inject or eject, transmit or pulse ions from the one or more further ion guides or ion traps into the preferred ion guide or ion trap.

The mass spectrometer preferably further comprises means arranged and adapted to substantially fragment ions within the one or more further ion guides or ion traps.

The one or more further ion guides or ion traps are preferably selected from the group consisting of:

(i) a multipole rod set or a segmented multipole rod set ion trap or ion guide comprising a quadrupole rod set, a hexapole rod set, an octapole rod set or a rod set comprising more than eight rods;

(ii) an ion tunnel or ion funnel ion trap or ion guide comprising a plurality of electrodes or at least 2, 5, 10, 20, 30, 40, 50, 60, 70, 80, 90 or 100 electrodes having apertures through which ions are transmitted in use, wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area;

(iii) a stack or array of planar, plate or mesh electrodes, wherein the stack or array of planar, plate or mesh electrodes comprises a plurality or at least 2, 3, 4, 5, 6, 7, 8, 9, 10, 11, 12, 13, 14, 15, 16, 17, 18, 19 or 20 planar, plate or mesh electrodes and wherein at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are arranged generally in the plane in which ions travel in use; and (iv) an ion trap or ion guide comprising a plurality of groups of electrodes arranged axially along the length of the ion trap or ion guide, wherein each group of electrodes comprises: (a) a first and a second electrode and means for applying a DC voltage or potential to the first and second electrodes in order to confine ions in a first radial direction within the ion guide; and (b) a third and a fourth electrode and means for applying an AC or RF voltage to the third and fourth electrodes in order to confine ions in a second radial direction (which is preferably orthogonal to the first radial direction) within the ion guide.

The one or more further ion traps or ion guides preferably comprise an ion tunnel or ion funnel ion trap or ion guide wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) ≦6.0 mm; (vii) ≦7.0 mm; (viii) ≦8.0 mm; (ix) ≦9.0 mm; (x) ≦10.0 mm; and (xi) >10.0 mm.

The one or more further ion traps or ion guides preferably further comprise first AC or RF voltage means arranged and adapted to apply an AC or RF voltage to at least 5%, 10%, 15%, 20%, 25%, 30%, 35%, 40%, 45%, 50%, 55%, 60%, 65%, 70%, 75%, 80%, 85%, 90%, 95% or 100% of the plurality of electrodes of the one or more further ion traps or ion guides in order to confine ions radially within the one or more further ion traps or ion guides. The first AC or RF voltage means is preferably arranged and adapted to apply an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. The first AC or RF voltage means is preferably arranged and adapted to apply an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The one or more further ion traps or ion guides are preferably arranged and adapted to receive a beam or group of ions and to convert or partition the beam or group of ions such that a plurality or at least 1, 2, 3, 4, 5, 6, 7, 8, 9, 10, 11, 12, 13, 14, 15, 16, 17, 18, 19 or 20 separate packets of ions are confined and/or isolated in the one or more further ion traps or ion guides at any particular time, and wherein each packet of ions is separately confined and/or isolated in a separate axial potential well formed within the one or more further ion traps or ion guides.

The mass spectrometer preferably further comprises means arranged and adapted to urge at least some ions upstream and/or downstream through or along at least 5%, 10%, 15%, 20%, 25%, 30%, 35%, 40%, 45%, 50%, 55%, 60%, 65%, 70%, 75%, 80%, 85%, 90%, 95% or 100% of the axial length of the one or more further ion traps or ion guides in a mode of operation.

The mass spectrometer preferably further comprises first transient DC voltage means arranged and adapted to apply one or more transient DC voltages or potentials or one or more transient DC voltage or potential waveforms to the electrodes forming the one or more further ion traps or ion guides in order to urge at least some ions upstream and/or downstream along at least 5%, 10%, 15%, 20%, 25%, 30%, 35%, 40%, 45%, 50%, 55%, 60%, 65%, 70%, 75%, 80%, 85%, 90%, 95% or 100% of the axial length of the one or more further ion traps or ion guides.

According to an embodiment the mass spectrometer further comprises AC or RF voltage means arranged and adapted to apply two or more phase-shifted AC or RF voltages to electrodes forming the one or more further ion traps or ion guides in order to urge at least some ions upstream and/or downstream along at least 5%, 10%, 15%, 20%, 25%, 30%, 35%, 40%, 45%, 50%, 55%, 60%, 65%, 70%, 75%, 80%, 85%, 90%, 95% or 100% of the axial length of the one or more further ion traps or ion guides.

The mass spectrometer preferably further comprises means arranged and adapted to introduce, axially inject or eject, radially inject or eject, transmit or pulse ions into the ion guide or ion trap.

The mass spectrometer preferably further comprises a mass filter or mass analyser arranged upstream and/or downstream of the ion guide or ion trap. The mass filter or mass analyser is preferably selected from the group consisting of: (i) a quadrupole rod set mass filter or mass analyser; (ii) a Time of Flight mass filter or mass analyser; (iii) a Wein filter; and (iv) a magnetic sector mass filter or analyser.

In a mode of operation: (i) the mass filter or mass analyser is operated in a substantially non-resolving or ion guiding mode of operation; or (ii) the mass filter or mass analyser is scanned or a mass to charge ratio transmission window of the mass filter or mass analyser is varied with time.

In a mode of operation the mass filter or mass analyser is preferably scanned or a mass to charge ratio transmission window of the mass filter or mass analyser is varied with time in synchronism with the operation of the ion guide or ion trap or with the mass to charge ratio of ions emerging from and/or being transmitted to the ion guide or ion trap.

The mass spectrometer preferably further comprises one or more ion detectors arranged upstream and/or downstream of the ion guide or ion trap.

The mass spectrometer preferably further comprises a mass analyser arranged downstream and/or upstream of the ion guide or ion trap. The mass analyser is preferably selected from the group consisting of: (i) a Fourier Transform ("FT") mass analyser; (ii) a Fourier Transform Ion Cyclotron Resonance ("FTICR") mass analyser; (iii) a Time of Flight ("TOF") mass analyser; (iv) an orthogonal acceleration Time of Flight ("oaTOF") mass analyser; (v) an axial acceleration Time of Flight mass analyser; (vi) a magnetic sector mass spectrometer; (vii) a Paul or 3D quadrupole mass analyser; (viii) a 2D or linear quadrupole mass analyser; (ix) a Penning trap mass analyser; (x) an ion trap mass analyser; (xi) a Fourier Transform orbitrap; (xii) an electrostatic Fourier Transform mass spectrometer; and (xiii) a quadrupole rod set mass filter or mass analyser.

According to another aspect of the present invention there is provided a method of guiding or trapping ions comprising:

providing a plurality of electrodes;

applying an AC or RF voltage to at least some of the plurality of electrodes in order to confine at least some ions radially within the ion guide or ion trap;

maintaining a DC or electrostatic electric field across at least a portion of the axial length of the ion guide or ion trap in order to confine at least some ions axially within an axial ion trapping region of the ion guide or ion trap, wherein the DC or electrostatic electric field is substantially linear across a first portion of the axial ion trapping region and is substantially non-linear across one or more second portions of the axial ion trapping region; and applying a supplemental AC voltage or potential to the electrodes in a first mode of operation in order to resonantly and/or parametrically eject at least some ions from the ion guide or ion trap.

According to another aspect of the present invention there is provided a method of mass spectrometry comprising the method as described above.

According to another aspect of the present invention there is provided an ion guide or ion trap comprising means for exciting ions wherein in a mode of operation the fundamental or resonance frequency of ions changes as the amplitude of oscillation of the ions increases.

According to another aspect of the present invention there is provided a method of guiding or trapping ions comprising:

exciting ions wherein the fundamental or resonance frequency of ions changes as the amplitude of oscillation of the ions increases.

The preferred embodiment relates to an improved method of ejecting ions in an axial manner from a linear RF ion trap.

According to the preferred embodiment a linear RF ion trap is provided wherein ions are confined axially within the ion trap. An electrostatic or DC potential gradient is superimposed along the axial length of the ion trap preferably about the centre or middle of the ion trap. The axial electrostatic field created by the potential gradient preferably exerts a force on ions displaced from the centre of the ion trap such as to accelerate ions back towards the centre of the ion trap.

A supplemental AC electric field is preferably applied to the electrodes of the ion trap in order to excite ions and to cause at least some ions to be ejected axially from the ion trap. Mass selective axial ejection of ions is preferably performed by altering or scanning the frequency of modulation of the supplemental AC voltage waveform. Alternatively, the depth of the axial DC or electrostatic potential well may be varied whilst the supplemental AC voltage waveform is applied to the ion trap and the frequency of the supplemental AC voltage waveform is kept substantially constant. Either approach preferably results in an increase in the amplitude of axial oscillations at a characteristic frequency of excitation for each mass to charge ratio. Ions are preferably sequentially ejected from the ion trap and are preferably detected by an ion detector. A mass spectrum may then be produced.

Along at least a portion of the axial length of the ion trap the electrostatic or DC electric field is substantially linear. Accordingly, the voltage or potential distribution along the central section of the ion trap is preferably substantially quadratic. However, according to the preferred embodiment the axial electric field is deliberately made non-linear at either end of the ion trap. According to the preferred embodiment the non-linear electric field at the ends of the ion trap enables the performance of the ion trap to be improved when either performing a forward scan (wherein ions are ejected sequentially from relatively low mass to charge ratios to relatively high mass to charge ratios) or when performing a reverse scan (wherein ions are ejected sequentially from relatively high mass to charge ratios to relatively low mass to charge ratios).

According to another embodiment the form of the supplemental axial AC electric field may be arranged such that the combination of the time averaged potential or pseudo-potential associated with the supplemental AC electric field and the static axial electrostatic or DC potential are arranged such that the performance of the ion trap when ejecting ions sequentially from relatively low mass to charge ratio to relatively high mass to charge ratio (i.e. forward scan) is optimised and/or the performance of the ion trap when ejecting ions sequentially from relatively high mass to charge ratio to relatively low mass to charge ratio (i.e. reverse scan) is optimised.

BRIEF DESCRIPTION OF THE DRAWINGS

Various embodiments of the present invention together with other arrangements given for illustrative purposes only will now be described, by way of example only, and with reference to the accompanying drawings in which.

DETAILED DESCRIPTION OF THE PREFERRED EMBODIMENTS

A preferred embodiment of the present invention will now be described with reference to FIG. 1. According to the preferred embodiment a segmented quadrupole rod set ion trap 1 is provided. The quadrupole rod-set ion trap 1 preferably comprises electrodes having arcuate or hyperbolic surfaces. The electrodes are preferably split or divided into n axial segments. The number n of axial segments is preferably arranged so as to allow electrostatic potentials to be applied to the axial electrode segments so that an electrostatic potential profile can be maintained in use which relaxes as close as is required to a quadratic function across the central portion of the ion trap 1.

Figure 1:
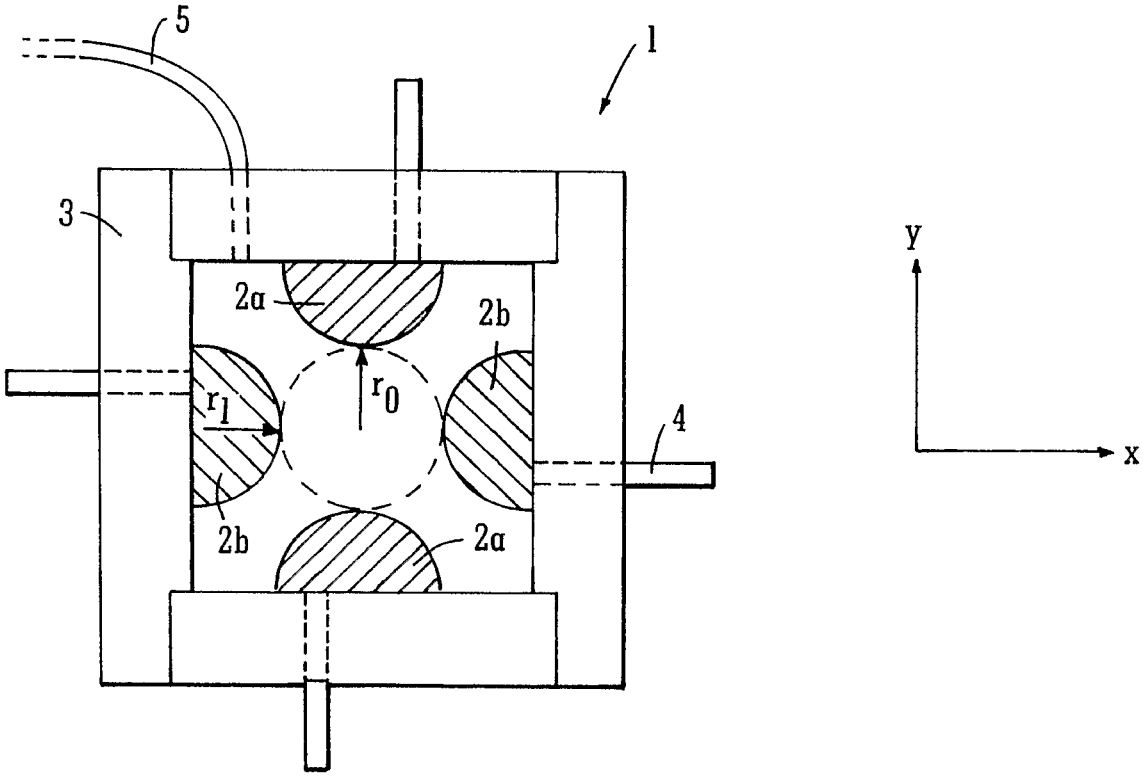
FIG. 1 shows an ion trap according to a preferred embodiment in the x,y plane.

FIG. 1 shows the ion guide or ion trap 1 viewed along the z- or axial direction. A pair of axially segmented rod electrodes 2*a*,2*b* are shown. The rod electrodes 2*a*,2*b* have a semi-circular cross section. The electrodes 2*a*,2*b* are shown mounted on a non-conductive or insulating substrate 3. Electrical connections to the electrodes 2*a*,2*b* are preferably made via pins 4 which preferably pass through the electrically insulating substrate 3.

Figure 2:
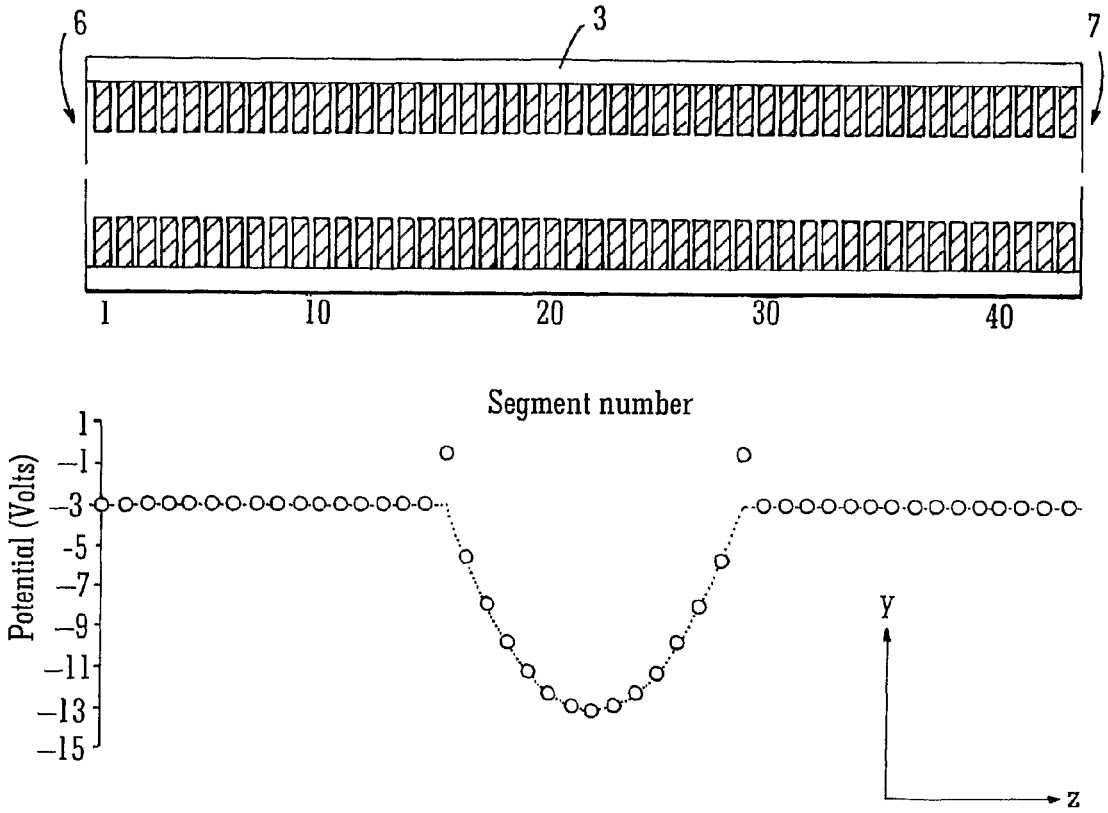
FIG. 2 shows an ion trap according to a preferred embodiment in the z,y plane together with a plot of the potential applied to each axial segment of the ion trap in a mode of operation.

FIG. 2 shows the ion guide or ion trap 1 viewed in the y,z plane and shows the individual axial electrode segments.

An alternating voltage modulated at radio frequency (RF voltage) is preferably applied to the four rods 2*a*,2*b* in order to create a radial pseudo-potential well which preferably acts to contain or confine ions in the x,y or radial direction. Referring to FIG. 1, the RF potential applied to the first electrode pair 2*a* may be described by:

$$\phi_1=\phi_o\cos(\Omega\cdot t) \tag{1}$$

The RF potential applied to the second electrode pair 2*b* may be described by:

$$\phi_2=-\phi_o\cos(\Omega\cdot t) \tag{2}$$

wherein $\phi_o$ is the 0-peak voltage of a radio frequency high voltage power supply, t is time in seconds and Ω is the angular frequency of the AC supply in radians/second.

The potential in the x,y direction can be approximated by:

$$\phi_{x,y}=\phi_o\cos(\Omega\cdot t)\frac{(x^2-y^2)}{2\cdot r_o^2} \tag{3}$$

wherein $r_o$ is the radius of an imaginary circle enclosed by the two pairs of electrodes 2*a*,2*b*.

Ion motion in the x,y or radial axis may be expressed in terms of a Mathieu type equation. The ion motion consists of low amplitude micro motion with a frequency related to the initial RF drive frequency and a larger secular motion with a frequency related to mass to charge ratio. The properties of this equation are well established and solutions resulting in stable ion motion are generally represented using a stability diagram by plotting the stability boundary conditions for the dimensionless parameters $a_u$ and $q_u$.

For this embodiment:

$$a_u = a_x = -a_y = \frac{8qU_0}{m\Omega^2 r_0^2} \quad (4)$$

$$q_u = q_x = -q_y = \frac{4q\phi_0}{m\Omega^2 r_0^2} \quad (5)$$

wherein m is the molecular mass of the ion, $U_0$ is a DC voltage applied to one of the pairs of electrodes with respect to the other pair and q is the electron charge e multiplied by the number of charges on the ions z:

$$q=z\cdot e \quad (6)$$

The operation of such a quadrupole device for mass analysis is well established.

In order to illustrate the general principle of operation of the preferred ion trap 1, in the following it is assumed that both the radial and axial trapping potentials are substantially quadratic and that a supplemental excitation potential is substantially linear. However, according to the preferred embodiment the axial trapping potential deviates from being quadratic at the ends of the ion trap in order to optimise the performance of the preferred ion trap 1 during mass selective ejection. Less preferred embodiments are contemplated wherein the supplemental excitation potential deviates from being linear in order to optimise the performance of the preferred ion trap 1.

The application of an RF voltage to the electrodes of the ion trap 1 as described above results in the formation of a pseudo-potential well in the radial direction. An approximation of the pseudo-potential well in the x direction may be given by:

$$V^*_{(x)} = \frac{q\cdot\phi_0^2\cdot x^2}{4\cdot\Omega\cdot m\cdot r_0^4} \quad (7)$$

The depth of the well is approximately:

$$\overline{D}_x = \frac{q_x\cdot\phi_0}{8} \quad (8)$$

for values of $q_x<0.4$.

As the quadrupole is cylindrically symmetrical an identical expression may be derived for the characteristics of the pseudo-potential well in the y axis.

In addition to the RF trapping potential, a DC potential profile is also preferably maintained along the length of the ion trap so that ions are preferably confined axially within the preferred ion trap 1. DC voltages are preferably applied to the electrodes of the ion trap 1 so that a resulting DC potential profile is maintained across the ion trap 1 which preferably has a minimum at the electrode segment(s) positioned at the centre or in the middle of the ion trap 1. The DC potential preferably increases as the square of the distance away from the centre of the ion trap 1 across the central portion of the ion trap 1.

The potential applied to the electrodes in the z- or axial direction across the central portion of the ion trap is preferably given by:

$$U_z = \frac{k\cdot z^2}{2} \quad (9)$$

where:

$$k = \frac{2DC_z}{L^2} \quad (10)$$

and wherein $DC_z$ is the depth of the axial potential well and L is one half of the length of the axial potential well.

The electric field $E_z$ across the central portion of the ion trap in the axial or z-direction is given by:

$$E_z = \frac{\delta U_z}{\delta z} = k\cdot z \quad (11)$$

The force $F_z$ across the central portion of the ion trap in the axial or z-direction is given by:

$$F_z=-q\cdot E_z=-q\cdot k\cdot z \quad (12)$$

The acceleration $A_z$ along the axial or z-axis is given by:

$$A_z = \ddot{z} = -\frac{q}{m}\cdot k\cdot z \quad (13)$$

The restoring force on a particular ion is directly proportional to the axial displacement of the ion from the centre of the superimposed DC potential well. Under these conditions ions will undergo simple harmonic oscillations in the axial or z-direction.

The exact solution of Eqn. 13 above is given by:

$$z(t)=z_0\cos(\omega\cdot t)+\sqrt{(2\cdot V/k}\cdot\sin(\omega\cdot t) \quad (14)$$

wherein V is the initial kinetic energy of the ion in the axial or z-direction at time t=0 and $z_0$ is the initial z coordinate of the ion. Also:

$$\omega=\sqrt{q\cdot k/m} \quad (15)$$

wherein ω is the angular frequency of simple harmonic motion of the ions in the axial direction.

From the above equation it can be seen that the angular frequency of oscillation in the axial direction is independent of the initial energy and starting position of an ion. The frequency is only dependent upon the mass to charge ratio (m/q) and the field strength constant k.

In the preferred embodiment the DC voltage applied to each individual electrode segment is generated using individual low voltage power supplies. The outputs of the low voltage power supplies may be controlled by a programmable microprocessor. The general form of the DC or electrostatic potential function in the axial direction can thus be rapidly manipulated. In addition complex and or time varying functions may be superimposed in the axial direction.

FIG. 2 shows the DC potential of each segment of the preferred ion guide 1 before ions are excited within the ion trap 1 in a manner according to the preferred embodiment of the present invention. The potential at which the electrodes are maintained may be varied or modified empirically in order to produce optimum performance. For example, the potential may be modified in order to allow axial ejection to occur preferentially in one axial direction or the other.

Embodiments are contemplated wherein different electrostatic trapping profiles may be applied to the segments of the ion guide or ion trap 1 in order to confine ions initially within the ion guide or ion trap 1.

According to the preferred embodiment an additional superimposed time varying AC voltage is then preferably applied to the electrode segments in order to excite ions. For ease of illustration only the additional time varying AC potential may be considered as being applied such that the potential varies in a substantially linear function with axial displacement along the length of the ion trap 1. The overall potential applied in the axial or z-direction is therefore time varying and may be described by:

$$U_z(t) = \frac{k \cdot z^2}{2} + a \cdot z\cos(\sigma t) \tag{16}$$

wherein σ is the angular frequency of the supplementary AC potential and a is the field constant for the superimposed axial AC potential.

The electric field $E_z$ across the central portion of the ion trap in the axial or z-direction is given by:

$$E_z(t) = \frac{\delta U_z}{\delta z} = k \cdot z + a\cos(\sigma t) \tag{17}$$

The force $F_z$ across the central portion of the ion trap in the axial or z-direction is given by:

$$F_z(t) = -q \cdot E_z(t) = -q \cdot (k \cdot z + a\cos(\sigma t)) \tag{18}$$

The acceleration $A_z$ along the axial or z-axis is given by:

$$A_z = \ddot{z} = -\frac{q}{m} \cdot (k \cdot z + a\cos(\sigma t)) \tag{19}$$

The equation of motion of an ion in the axial or z-direction is given by:

$$\ddot{z} + \frac{q}{m} \cdot k \cdot z = -\frac{q}{m} a\cos(\Omega \cdot t) \tag{20}$$

This equation describes a forced linear harmonic oscillator. The exact solution is given below:

$$z(t) = z_1\cos(\omega \cdot t) + \sqrt{(2 \cdot V/k)} \cdot \sin(\omega \cdot t) + \frac{q \cdot a}{m(\omega^2 - \sigma^2)}\begin{bmatrix} \cos(\sigma \cdot t) - \\ \cos(\omega \cdot t) \end{bmatrix} \tag{21}$$

wherein $z_1$ is the initial z coordinate of the ion at time t=0 and V is the initial kinetic energy of the ion in the z direction at t=0. Also:

$$\omega = \sqrt{q \cdot k/m} \tag{21a}$$

and is the angular frequency of simple harmonic motion of the ion within the axial DC or electrostatic well.

It can be seen that in the situation wherein the axial electrostatic or DC potential well is quadratic as described by Eqn. 9 then the amplitude of ion motion will increase as the frequency of the excitation potential σ approaches the fundamental or resonance frequency of the ions oscillation ω. The amplitude of ion motion will therefore increase and will reach a maximum when σ=ω. Under these conditions the ion is at resonance and ions will be ejected from the ion trap by resonance ejection. It is also apparent that the frequency of oscillation of the ion in the electrostatic or DC potential well ω will remain the same regardless of the amplitude of oscillation.

More generally excitation will be dominated by resonance at the fundamental harmonic frequency when the excitation waveform is dipolar and of a form which may be expressed by the general series expansion:

$$V(t) = \cos(\sigma t) \cdot \sum_{n=0}^{\infty} C_n z^{(2n+1)} \tag{22}$$

wherein n is an integer number n=0 . . . ∞, $C_n$ are coefficients for each order term and σ is the frequency of modulation of the additional axial excitation potential.

It is also possible to increase the amplitude of the ion oscillation within the axial electrostatic well by application of a non-dipolar excitation potential which may be expressed by the general series expansion:

$$V(t) = \cos(\sigma t) \cdot \sum_{n=0}^{\infty} C_n z^{(2n+2)} \tag{23}$$

wherein n is an integer number n=0 . . . ∞, $C_n$ are coefficients for each order term and σ is the frequency of modulation of the additional axial excitation potential. In this case ions undergo parametric excitation.

Two types of analytical scan may be used in order to effect mass selective axial ejection of ions from the preferred ion trap. Firstly, a reverse scan may be performed wherein ions having relatively high mass to charge ratios are ejected from the ion trap 1 before ions having relatively low mass to charge ratios. Secondly, a forward scan may be performed wherein ions having relatively low mass to charge ratios are ejected from the ion trap 1 before ions having relatively high mass to charge ratios.

To effect a forward scan the depth of the axial electrostatic or DC potential well may be fixed. The frequency of the AC excitation potential may then scanned from a frequency above the characteristic oscillation or resonance frequency of ions with the lowest mass to charge ratio of interest to a frequency below the characteristic oscillation or resonance frequency of ions with the highest mass to charge ratio of interest. In this case ions having relatively low mass to charge ratios will be ejected from the ion trap 1 before ions having relatively high mass to charge ratios.

According to another embodiment the frequency of the AC excitation potential may be fixed at a value above the characteristic oscillation frequency of ions with the lowest mass to charge ratio of interest. The depth of the axial electrostatic or DC potential well may then be increased until the characteristic oscillation or resonance frequency of ions with the highest mass to charge ratio of interest exceeds the frequency of the AC excitation voltage. In this case ions having relatively low mass to charge ratios will be ejected from the ion trap 1 before ions having relatively high mass to charge ratios.

In order to effect a reverse scan the depth of the axial electrostatic or DC potential well may be fixed. The frequency of the AC excitation potential may then be scanned from a frequency below the characteristic oscillation or resonance frequency of ions with the highest mass to charge ratio of interest to a frequency above the characteristic oscillation or resonance frequency of ions with the lowest mass to charge ratio of interest. In this case ions having relatively high mass to charge ratios will be ejected from the ion trap 1 before ions having relatively low mass to charge ratios.

According to another embodiment the frequency of the AC excitation potential may be fixed at a value below the characteristic oscillation or resonance frequency of ions with the highest mass to charge ratio of interest. The depth of the axial electrostatic or DC potential well may then be decreased until the characteristic oscillation or resonance frequency of ions with the lowest mass to charge ratio of interest is below the frequency of the AC excitation voltage. In this case ions having relatively high mass to charge ratios will be ejected from the ion trap before ions having relatively low mass to charge ratios.

In the above described embodiments if the electrostatic or DC axial field is linear over the whole length of the ion trap then it would be expected that the resonance absorption peak shape will be symmetrical and to a first order approximately Lorenzian. Accordingly, for a given mass to charge ratio and fundamental harmonic or resonance frequency $\omega$, the growth in the oscillation amplitude during a forward or reverse scan using identical rates of change of the parameter scanned should be identical. It therefore follows that the mass resolution obtained using a forward or a reverse scan in a conventional ion trap should be identical.

FIGS. 3-6 illustrate conventional approaches to ejecting ions in a resonant manner from an ion trap. A linear axial electrostatic or DC electric field is maintained along the length of the ion trap and during an analytical scan the resonance frequency of oscillation of the ions does not change with the amplitude of oscillation of the ions.

Figure 3:
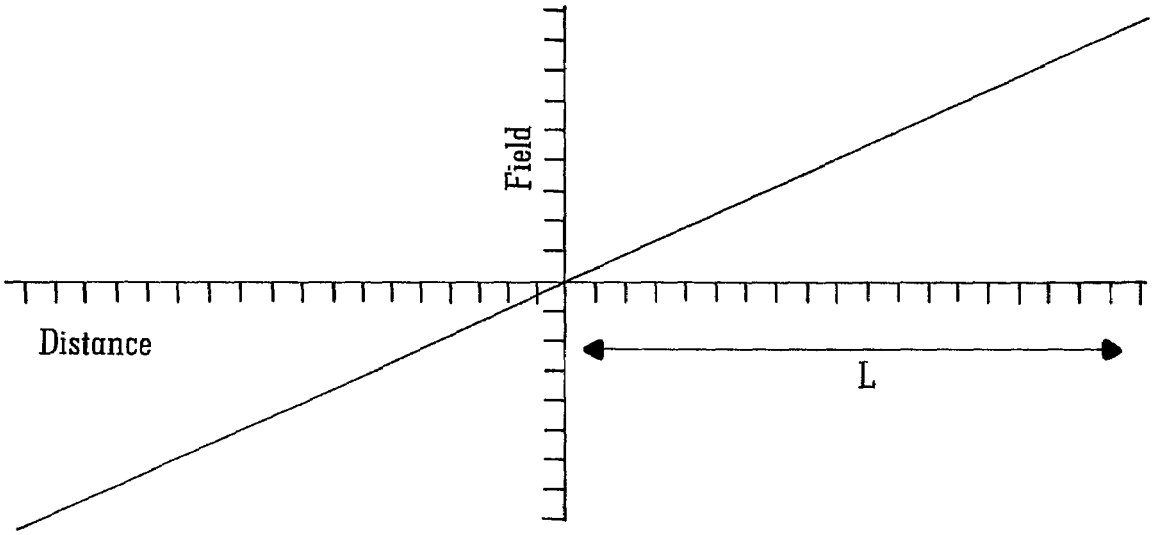
FIG. 3 PRIOR ART
FIG. 3 shows a linear electrostatic or DC electric field which is maintained conventionally along the axis of an ion trap.

FIG. 3 shows a plot of axial electrostatic or DC electric field versus distance along the length of a conventional ion trap. The electrostatic or DC electric field along the length of the conventional ion trap is linear i.e. the electrostatic potential maintained along the length of the ion trap is quadratic and has a minimum at the origin (i.e. centre or middle of the ion trap). The ion trap has a length of 2 L.

Figure 4:
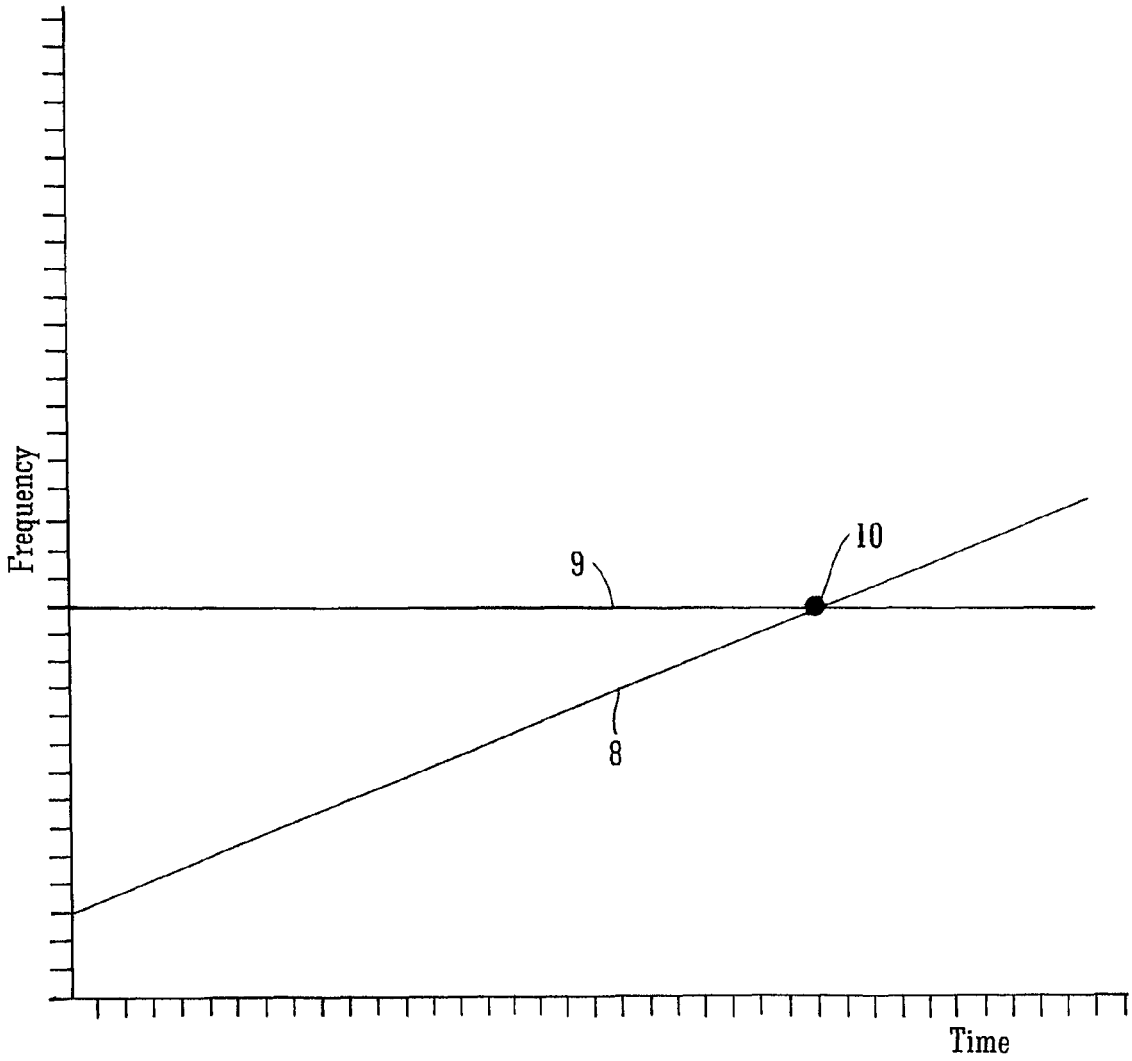
FIG. 4 PRIOR ART
FIG. 4 shows how conventionally the frequency of a supplemental AC voltage applied to an ion trap may be increased during a reverse scan until ions are resonantly ejected from the ion trap.

FIG. 4 shows a plot of how the frequency of a supplemental AC voltage applied to the ion trap may be increased with time in order to cause ions to be ejected from the conventional ion trap in reverse order of mass to charge ratio (i.e. reverse scan). The plot is for a single value of mass to charge ratio. The frequency $\sigma$ of the AC excitation voltage 8 applied to the ion trap is increased linearly with time from an initial value which is below the characteristic oscillation or resonance frequency $\omega$ of the ion as indicated by line 9. The ion is in resonance when the frequency $\sigma$ of the AC excitation voltage equals the resonance frequency $\omega$ of the ion (see point 10).

Figure 5:
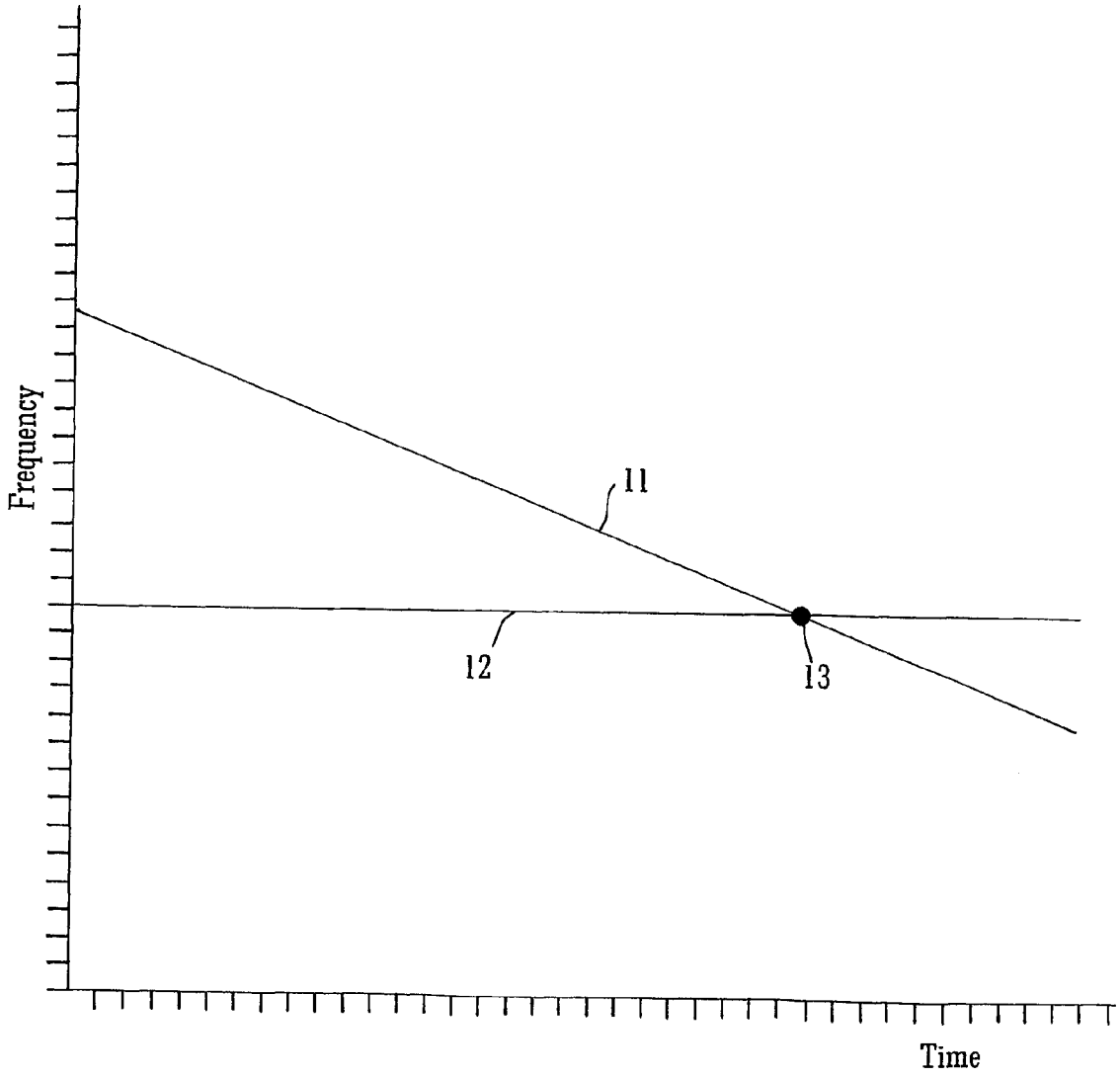
FIG. 5 PRIOR ART
FIG. 5 shows how conventionally the frequency of a supplemental AC voltage applied to an ion trap may be decreased during a forward scan until ions are resonantly ejected from the ion trap.

FIG. 5 shows a plot of how the frequency of a supplemental AC voltage may be decreased with time in order to cause ions to be ejected from a conventional ion trap in order of their mass to charge ratio (i.e. forward scan). The plot is for a single value of mass to charge ratio. The frequency $\sigma$ of the AC excitation voltage 11 applied to the ion trap is decreased linearly with time from an initial value which is above the characteristic oscillation or resonance frequency $\omega$ of the ion as indicated by line 12. The ion is in resonance when the frequency $\sigma$ of the AC excitation voltage equals the resonance frequency $\omega$ of the ion (see point 13).

Figure 6:
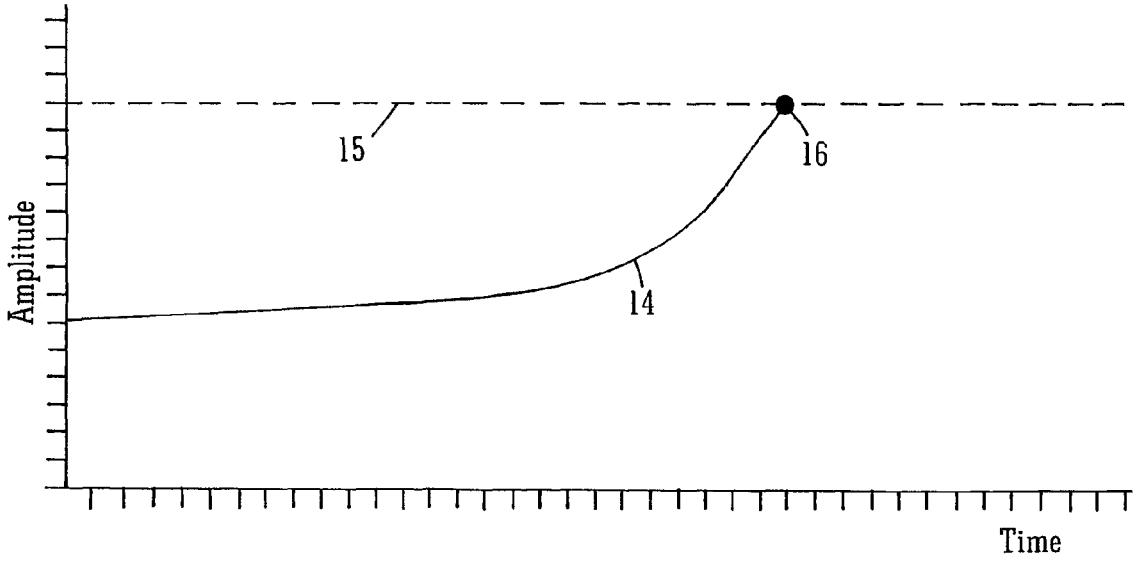
FIG. 6 PRIOR ART
FIG. 6 shows how for both a conventional reverse scan and a conventional forward scan the amplitude of ion oscillation increases with time until ions are resonantly ejected from the ion trap.

FIG. 6 shows a plot of oscillation amplitude 14 versus time for ions having the same mass to charge ratio as modelled above in relation to FIGS. 4 and 5 and wherein either a reverse scan or a forward scan is performed. The physical boundary of the ion trap is indicated by the dashed line 15 i.e. if ions have an amplitude which exceeds the dashed line 15 then the ions will be ejected from the ion trap. Ions will exit the ion trap and can be detected by an ion detector when the amplitude of their oscillation exceeds the dimension of the ion trap at a certain time 16.

According to the conventional approach of resonantly ejecting ions from an ion trap there is no change in the fundamental or resonance frequency $\omega$ of the axial oscillations of ions as the amplitude of the oscillations of the ions increases. Furthermore, the ions are ejected at the same supplemental AC frequency $\sigma$ irrespective of whether a forward or reverse scan is being performed.

Preferred embodiments of the present invention will now be described which represent an improved method of resonantly or parametrically ejecting ions from an ion trap and which results in improved mass resolution. According to the preferred embodiment the axial electrostatic or DC electric field is distorted at the ends of the ion trap so that the axial electrostatic or DC electric field is non-linear across the end regions of the preferred ion trap. The distortion to the axial electrostatic or DC electric field causes the frequency of ion oscillation or resonance frequency $\omega$ to vary as the amplitude of oscillation of the ions increases.

FIGS. 7-11 illustrate various different aspects of a first preferred embodiment of the present invention wherein the electric field strength maintained along the length of the preferred ion trap 1 deviates from a linear function at the ends of the ion trap in such a way that the frequency of oscillation of an ion or the resonance frequency $\omega$ of ions increases as ions oscillate with relatively large amplitude over the end regions of the ion trap 1 just prior be ejected from the ion trap 1.

Figure 7:
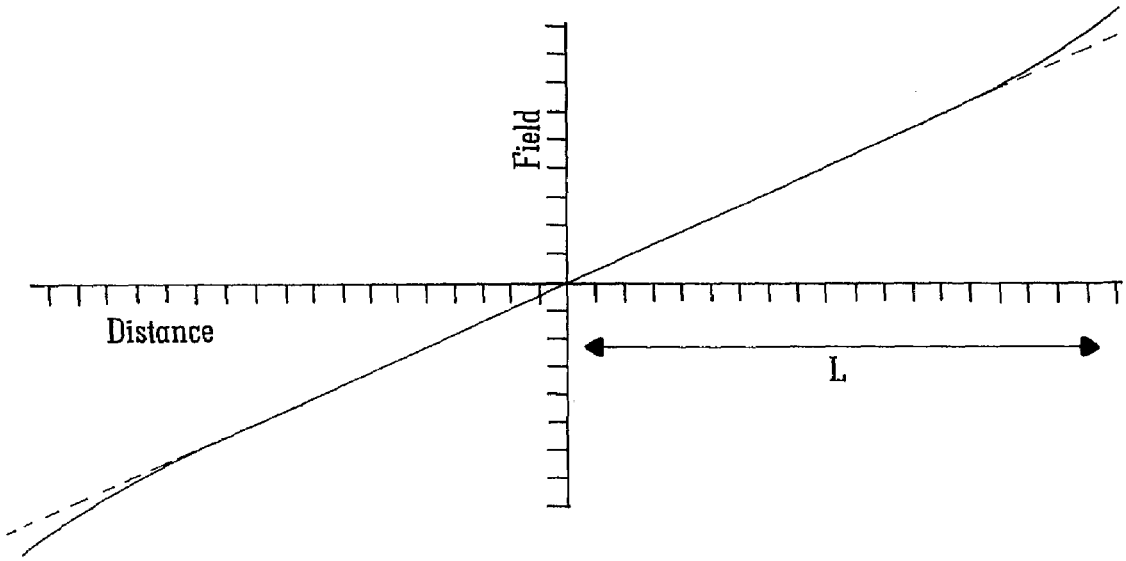
FIG. 7 shows an electrostatic or DC electric field which is maintained along the axis of an ion trap according to a first preferred embodiment wherein the electric field is non-linear at the ends of the ion trap.

FIG. 7 shows a plot of axial electrostatic or DC electric field maintained along the length of an ion trap according to the first preferred embodiment. The resulting axial electrostatic or DC potential well has a minimum at the origin (i.e. centre or middle of the ion trap 1). The ion trap preferably has an axial length of 2 L. The dashed line shows an undistorted or linear electric field which would be maintained across an ion trap according to a conventional arrangement.

Figure 8:
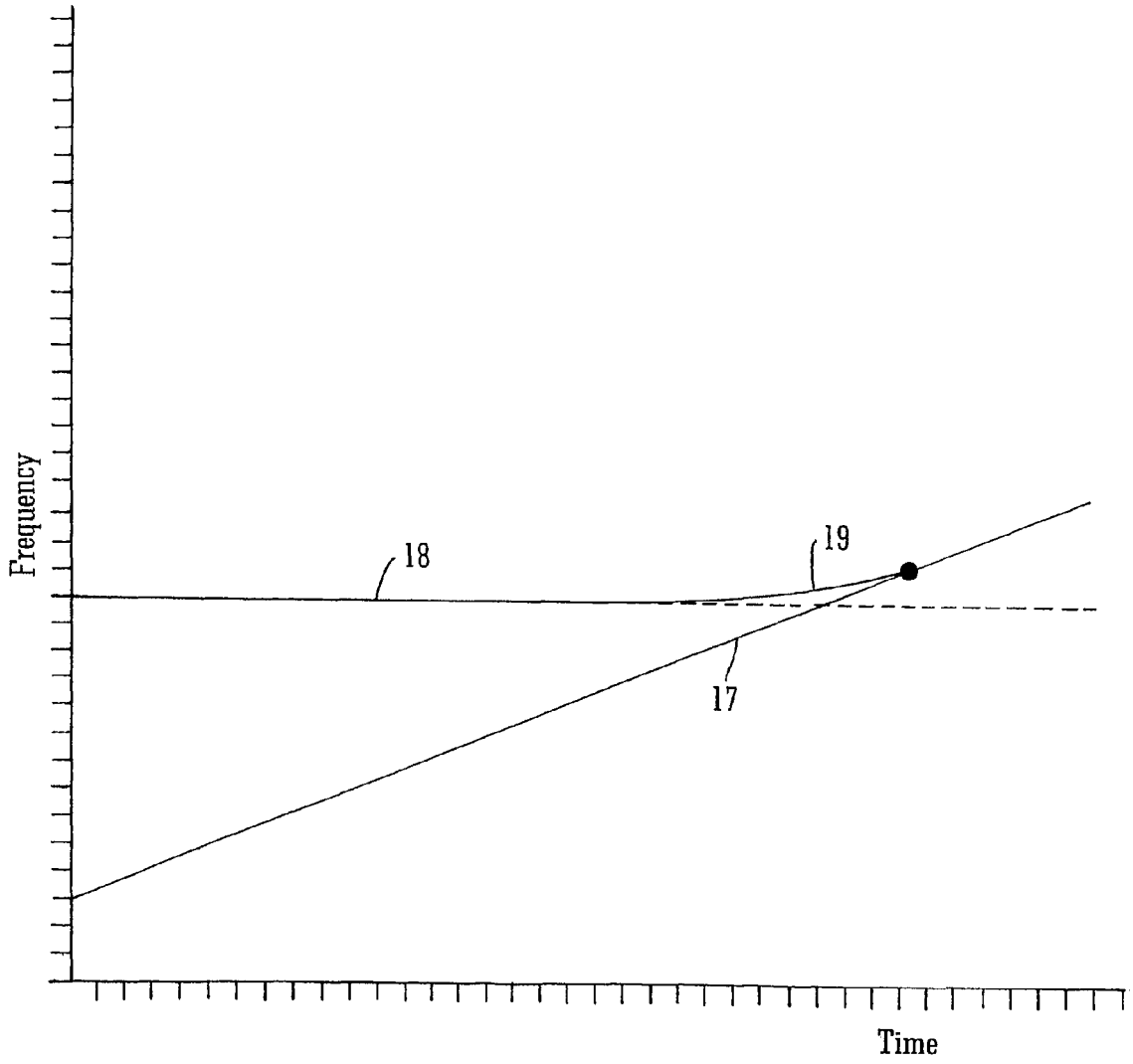
FIG. 8 shows how the resonance frequency of ions is increased if a reverse scan is performed according to a less preferred embodiment of the present invention.

FIG. 8 illustrates how the frequency of a supplemental AC voltage applied to the preferred ion trap 1 may be increased with time in order to cause ions to be ejected from the preferred ion trap 1 in reverse order of mass to charge ratio (i.e. reverse scan). The plot is for a single value of mass to charge ratio. According to this embodiment the frequency $\sigma$ of the AC excitation voltage 17 applied to the preferred ion trap 1 is increased linearly with time from an initial value which is below the characteristic oscillation or resonance frequency $\omega$ of the ion as indicated by line 18. The ion is in resonance when the frequency $\sigma$ of the AC excitation voltage equals the resonance frequency $\omega$ of the ion. However, it can be seen that although the oscillation or resonance frequency $\omega$ of the ion (line 18) initially remains substantially constant as the AC excitation frequency $\sigma$ is increased, as the conventional resonance condition is approached and as the amplitude of oscillation increases, then the resonance frequency 19 of the ions becomes shifted to higher values due to the non-linearity in the applied axial electric field. This shift moves the frequency of simple harmonic motion ion oscillation away from the supplemental AC excitation frequency and delays the growth in the oscillation amplitude.

Figure 9:
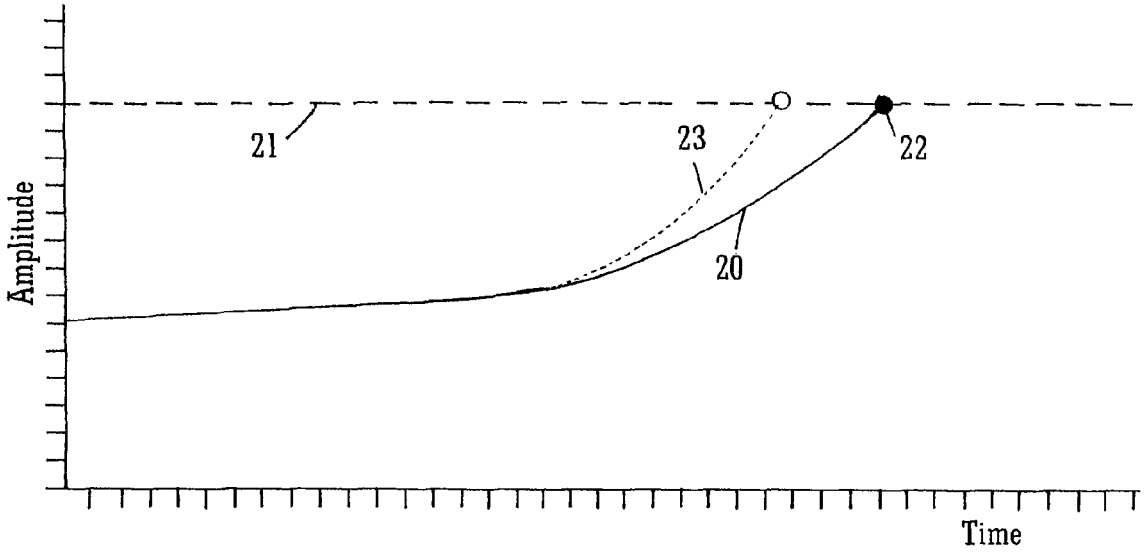
FIG. 9 shows how the amplitude of ion oscillation increases more slowly with time during a reverse scan according to a less preferred embodiment of the present invention.

FIG. 9 shows a plot of oscillation amplitude 20 versus time for ions having the same mass to charge ratio and under the same analytical scan conditions as described above in relation to FIGS. 7 and 8. The physical boundary of the preferred ion trap is shown by the dashed line 21 i.e. if ions have an amplitude which exceeds the dashed line 21 then the ions will be ejected from the ion trap 1. Ions will exit the ion trap 1 and can be detected by an ion detector when the amplitude of their oscillation exceeds the dimension of the ion trap at a certain time 22. The effect of the distortion in the electric field at the ends of the ion trap 1 is to delay the growth in oscillation amplitude compared with the conventional situation if no electric field distortion at the ends of the ion trap were present. The amplitude of ion oscillation and the earlier ejection of ions from a conventional ion trap is indicated by dotted line 23. The delay in ion ejection will lead to a degradation of mass resolution for reverse scans and hence the reverse scan approach as illustrated by FIGS. 8 and 9 in conjunction with an electric field as shown in FIG. 7 represents a less preferred embodiment.

Figure 10:
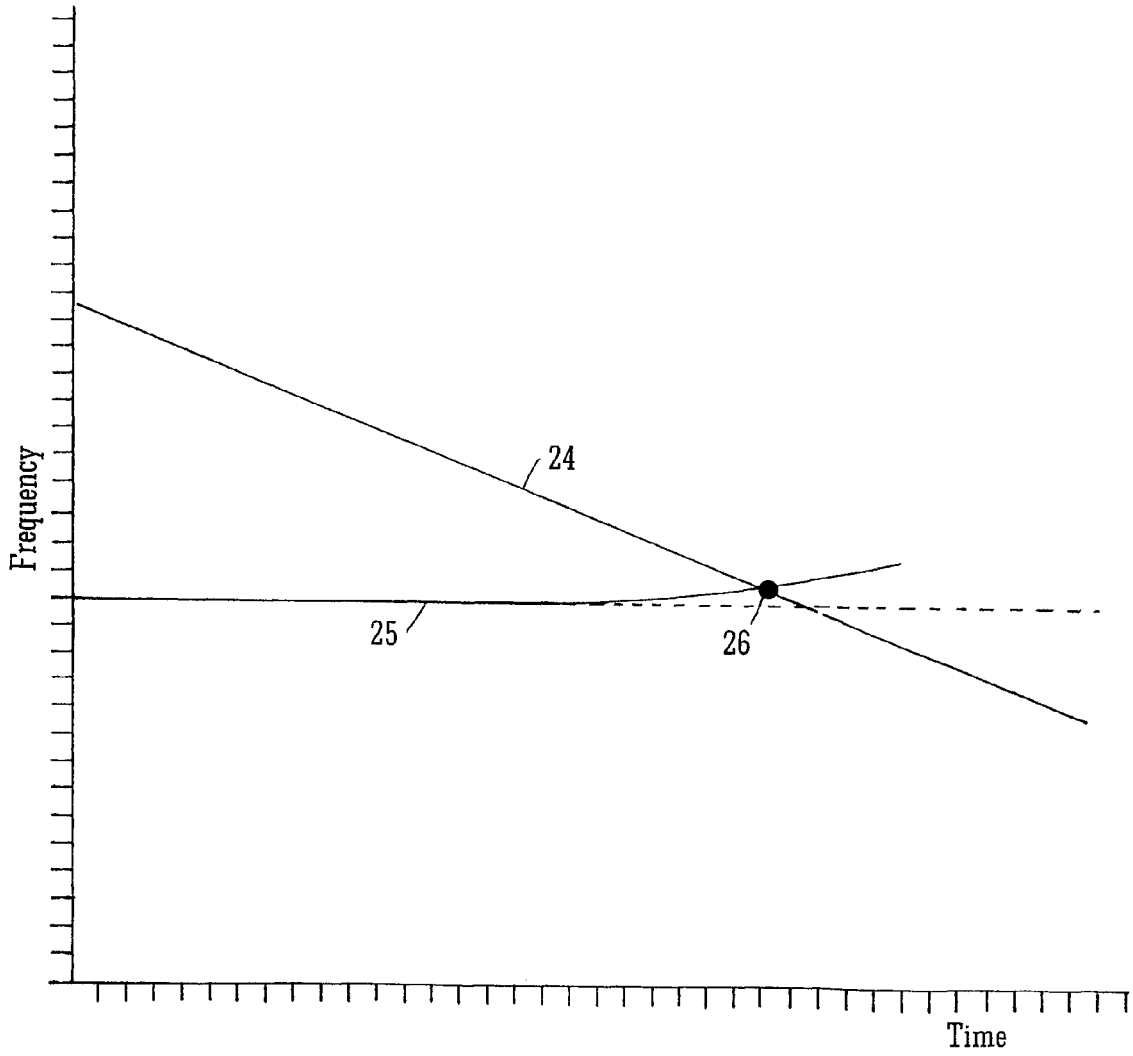
FIG. 10 shows how the resonance frequency of ions is increased during a forward scan according to the first preferred embodiment of the present invention.

FIG. 10 shows a plot of a first preferred embodiment of the present invention wherein the frequency of the supplemental AC voltage is decreased with time in order cause ions to be ejected from the preferred ion trap 1 in order of their mass to charge ratio (i.e. forward scan). The plot is for a single value of mass to charge ratio. The frequency σ of the AC excitation voltage 24 applied to the ion trap 1 is preferably decreased linearly with time from an initial value which is above the characteristic oscillation or resonance frequency ω of the ion as indicated by line 25. The ion is in resonance when the frequency σ of the AC excitation voltage equals the resonance frequency ω of the ion (see point 26). It can be seen that the oscillation or resonance frequency ω of the ion (line 25) remains substantially constant as the AC excitation frequency σ is decreased until a point approaching the resonance condition (point 26) is reached. As the amplitude of oscillation increases then the resonance frequency of the ions becomes shifted to higher values due to the non-linearity of the electric field applied across the ends of the ion trap. This shift moves the resonance frequency towards the frequency of the supplemental AC excitation frequency σ and causes the amplitude of oscillation to increase more rapidly until ions are ejected from the ion trap 1.

Figure 11:
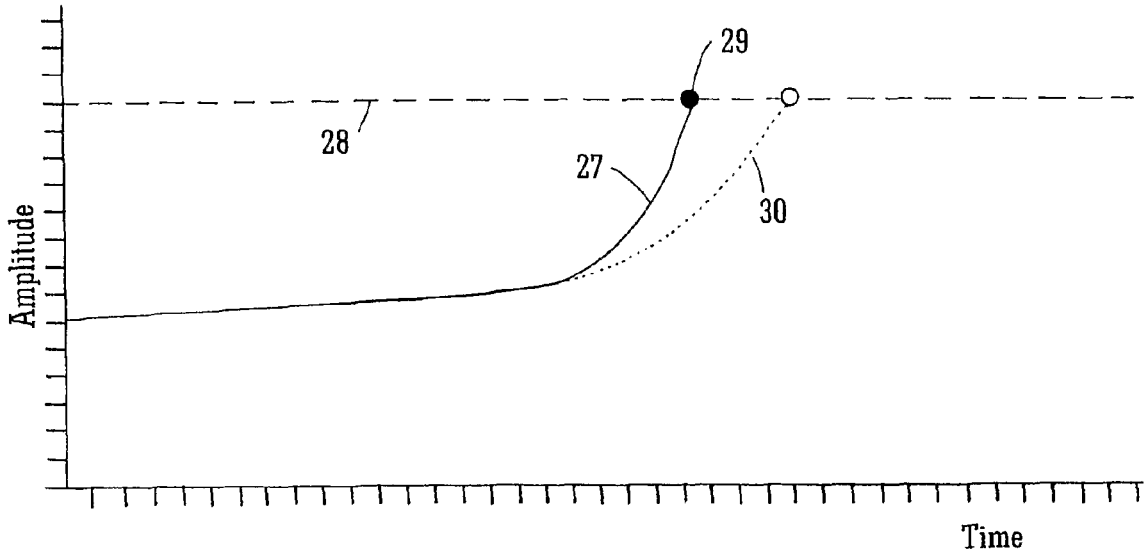
FIG. 11 shows how the amplitude of ion oscillation increases more rapidly with time during a forward scan according to the first preferred embodiment of the present invention.

FIG. 11 shows a plot of oscillation amplitude 27 versus time for ions having the same mass to charge ratio and under the same analytical scan conditions as described above in relation to FIG. 10. The physical boundary of the preferred ion trap 1 is shown by the dashed line 28 i.e. if ions have an amplitude which exceeds the dashed line 28 then the ions will be ejected from the ion trap 1. Ions will exit the ion trap 1 and can be detected by an ion detector when the amplitude of their oscillation exceeds the dimension of the ion trap at a certain time 29. The effect of the distortion in the electric field at the ends of the ion trap 1 is to accelerate the growth in oscillation amplitude compared with the conventional situation where no electric field distortion is present. The amplitude of ion oscillation and the later ejection of ions from a conventional ion trap is indicated by dotted line 30. In this case where the resonance frequency ω runs into the AC excitation frequency σ then ions are ejected from the ion trap 1 in a shorter period of time which leads to sharper peaks. Accordingly, mass resolution is therefore improved for a preferred ion trap 1 operated in a forward scan mode of operation wherein the electric field maintained across the length of the ion trap 1 is as shown in FIG. 7.

FIGS. 12-16 illustrate various different aspects of a second preferred embodiment wherein the electric field strength maintained along the length of the preferred ion trap 1 deviates from a linear function across the ends of the ion trap 1 in such a way that the resonance frequency ω of an ion decreases as ions oscillate with relatively large amplitude over the ends of the ion trap 1 just prior to being ejected from the ion trap 1.

Figure 12:
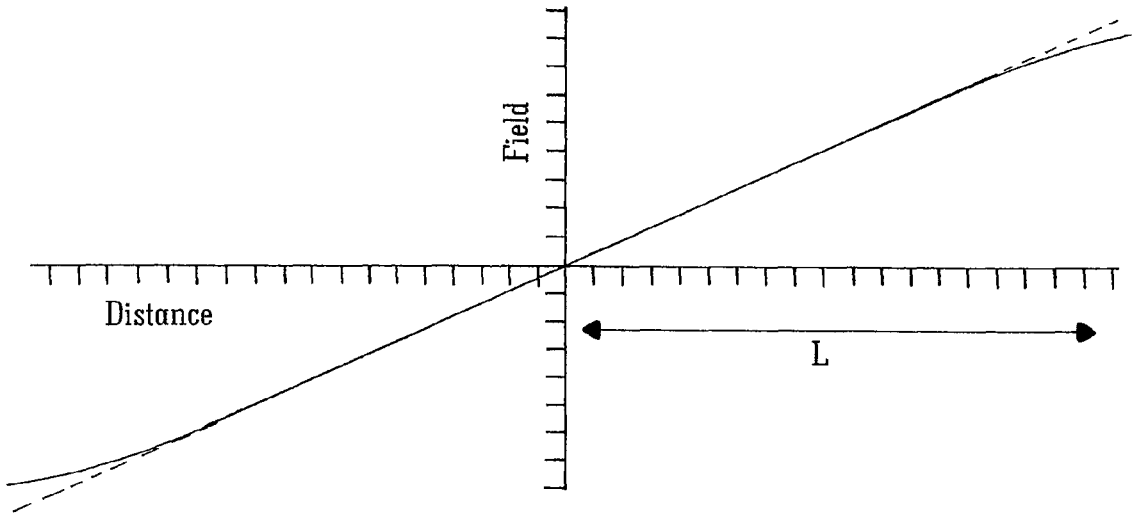
FIG. 12 shows an electrostatic or DC electric field which is maintained along the axis of an ion trap according to a second preferred embodiment wherein the electric field is non-linear at the ends of the ion trap.

FIG. 12 shows a plot of the axial electrostatic or DC electric field maintained along the length of the preferred ion trap 1 according to the second preferred embodiment. The corresponding axial electrostatic or DC potential well has a minimum at the origin (i.e. the centre or middle of the ion trap 1). The ion trap preferably has an axial length of 2 L. The dashed line shows an undistorted or linear electric field which is maintained along the length a conventional ion trap.

Figure 13:
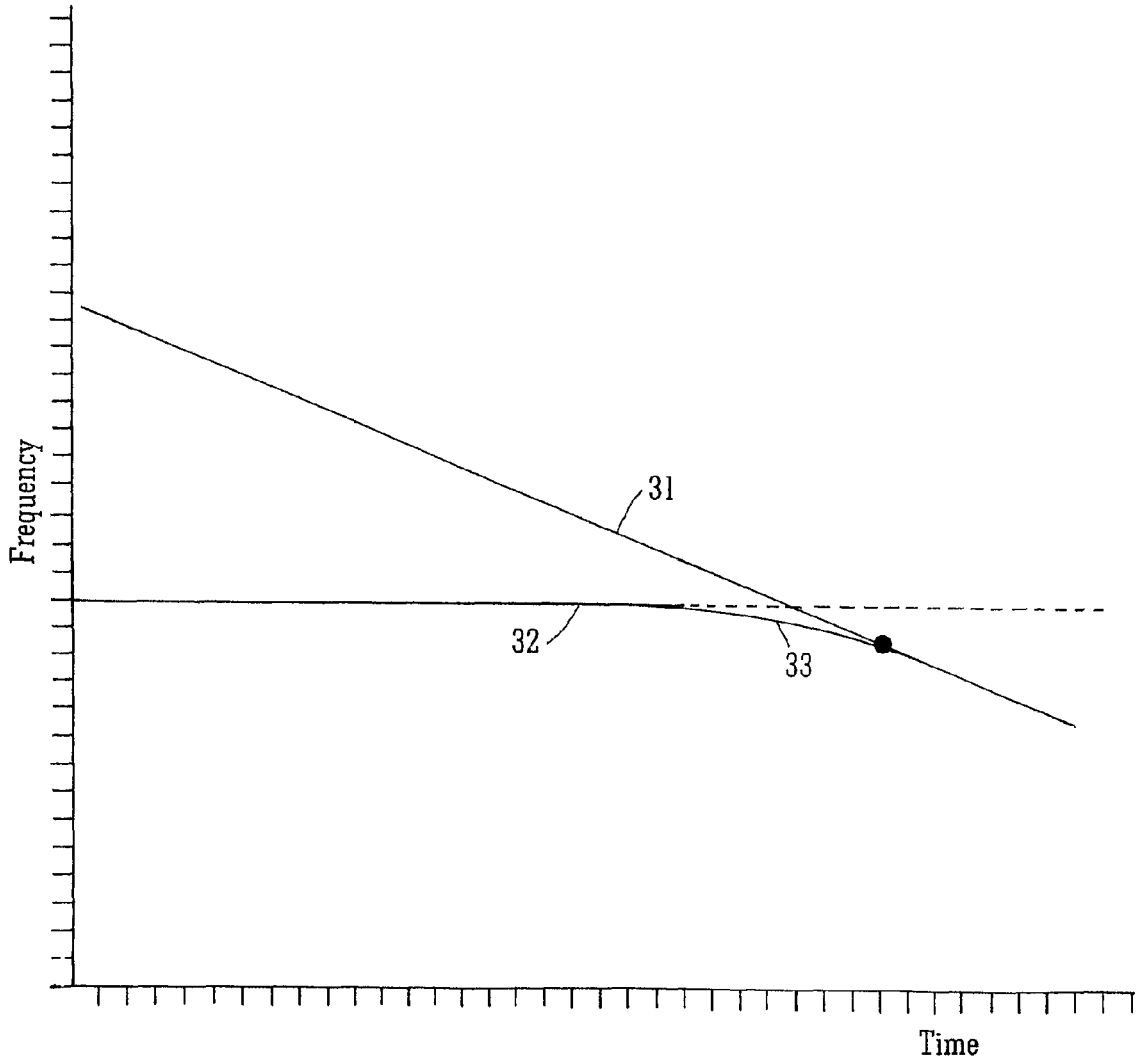
FIG. 13 shows how the resonance frequency of ions is decreased if a forward scan is performed according to a less preferred embodiment of the present invention.

FIG. 13 shows a plot of how the frequency of a supplemental AC voltage applied to the preferred ion trap 1 may be decreased with time in order to cause ions to be ejected from the preferred ion trap 1 in order of their mass to charge ratio (i.e. forward scan) according to a less preferred embodiment of the present invention. The plot is for a single value of mass to charge ratio. According to this embodiment the frequency σ of the AC excitation voltage 31 is decreased linearly with time from a value which is above the characteristic oscillation or resonance frequency ω of the ion (line 32). The ion is in resonance when the frequency σ of the AC excitation voltage equals the resonance frequency ω of the ion. It can be seen that the oscillation or resonance frequency ω of the ion (line 32) remains substantially constant as the AC excitation frequency σ is decreased until a point approaching the resonance condition is reached. As the amplitude of oscillation increases then the resonance frequency 33 of the ions becomes shifted to lower values due to the non-linearity of the electric field across the ends of the ion trap 1. This shift moves the resonance frequency away from the AC excitation frequency and delays the growth in the oscillation amplitude.

Figure 14:
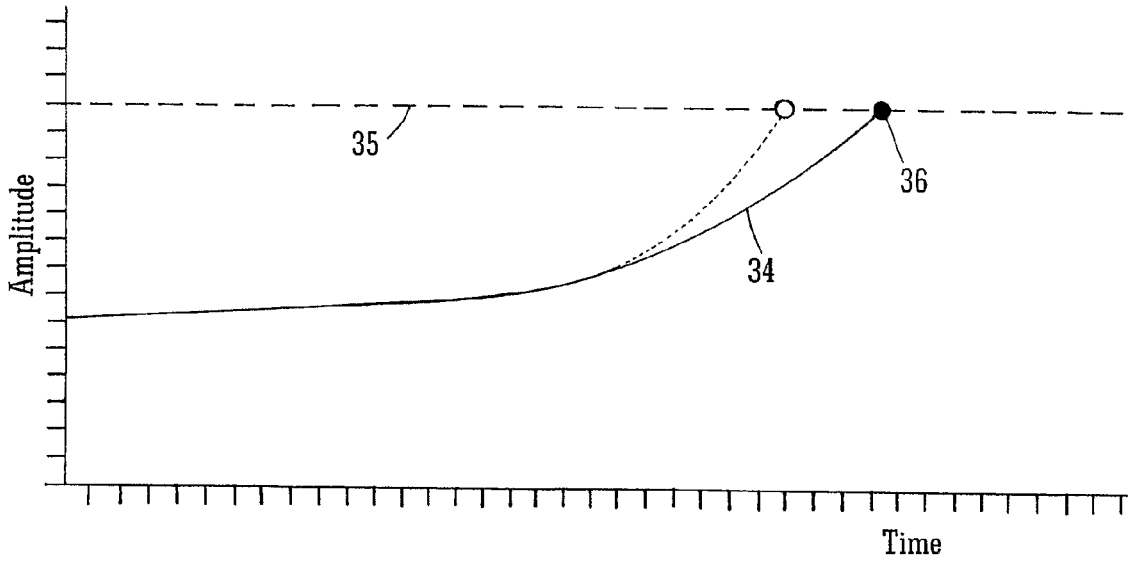
FIG. 14 shows how the amplitude of ion oscillation increases more slowly with time during a forward scan according to a less preferred embodiment of the present invention.

FIG. 14 shows a plot of oscillation amplitude 34 versus time for ions having the same mass to charge ratio and for the same analytical scan condition as described above with reference to FIG. 13. The physical boundary of the preferred ion trap is shown by the dashed line 35. Ions will exit the ion trap 1 and can be detected by an ion detector when the amplitude of their oscillation exceeds the dimension of the ion trap at a certain time 36. The effect of the distortion in the electric field at the ends of the ion trap 1 as shown in FIG. 12 is to delay the growth in oscillation amplitude compared with the conventional situation wherein the electric field is linear across the whole of the ion trap. The amplitude of ion oscillation and the earlier ejection of ions from a conventional ion trap is indicated by the dotted line shown in FIG. 14. The delay in ion ejection leads to a degradation of mass resolution for forward scans and hence the approach as illustrated by FIGS. 13 and 14 represents a less preferred embodiment.

Figure 15:
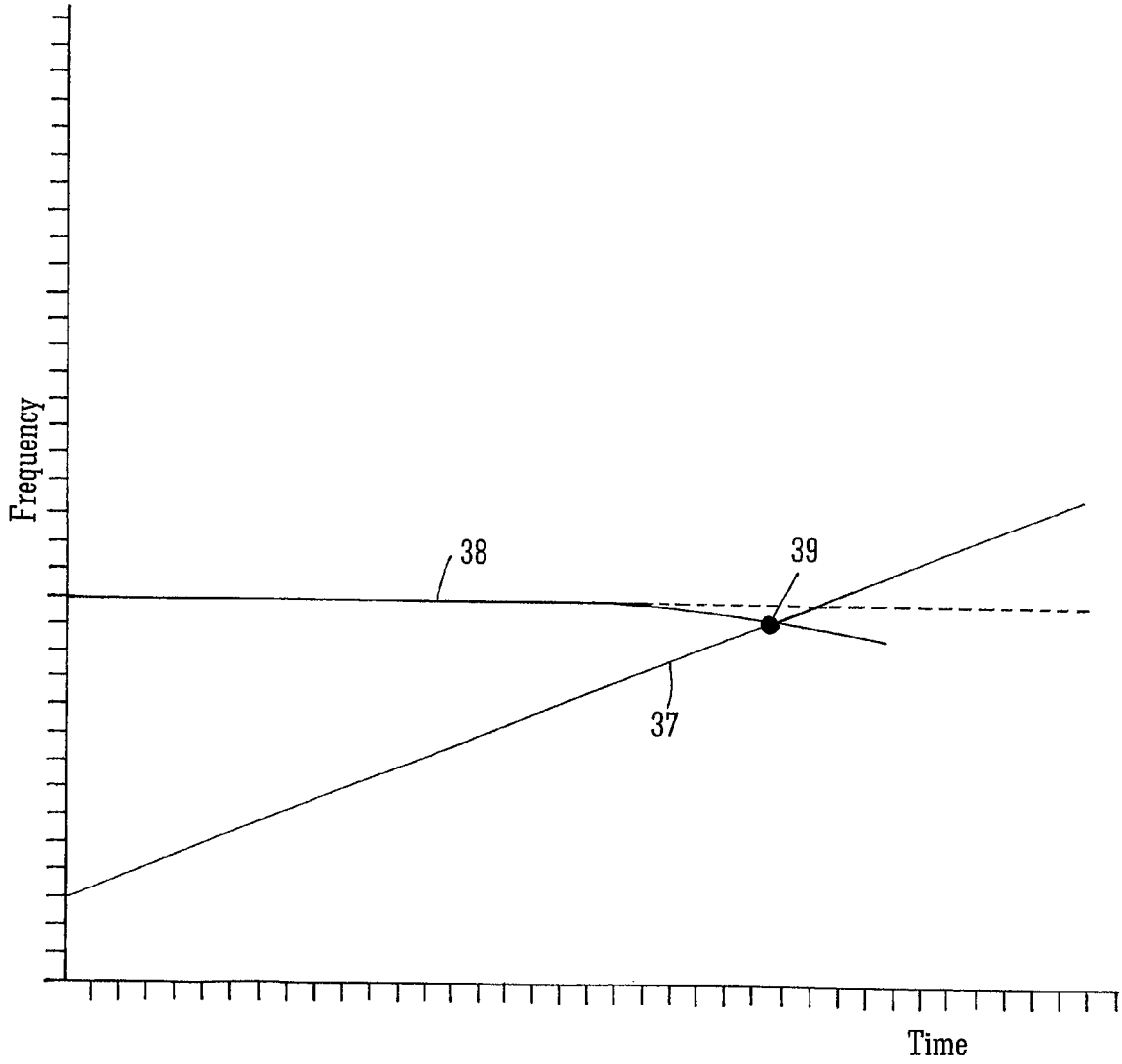
FIG. 15 shows how the resonance frequency of ions is decreased during a reverse scan according to the second preferred embodiment of the present invention.

FIG. 15 shows a plot illustrating a second preferred embodiment of the present invention wherein the frequency of a supplemental AC voltage applied to the preferred ion trap 1 is increased with time in order to cause ions to be ejected from the preferred ion trap 1 in reverse order of their mass to charge ratio (i.e. a reverse scan). The frequency σ of the AC excitation voltage 37 is increased linearly with time from an initial value which is below the characteristic oscillation or resonance frequency ω of the ion as indicated by line 38. The ion is in resonance when the frequency σ of the AC excitation voltage equals the resonance frequency ω of the ion (see point 39). It can be seen that the oscillation or resonance frequency ω of the ion (line 38) remains substantially constant as the AC excitation frequency σ is increased until a point approaching the resonance condition is reached. As the amplitude of oscillation increases then the resonance frequency of the ions becomes shifted to lower values due to the non-linearity of the electric field maintained across the ends of the ion trap 1. This shift moves the resonance frequency towards the frequency of the supplemental AC excitation frequency σ and causes the amplitude of oscillation to increase more rapidly until ions are ejected from the preferred ion trap 1.

Figure 16:
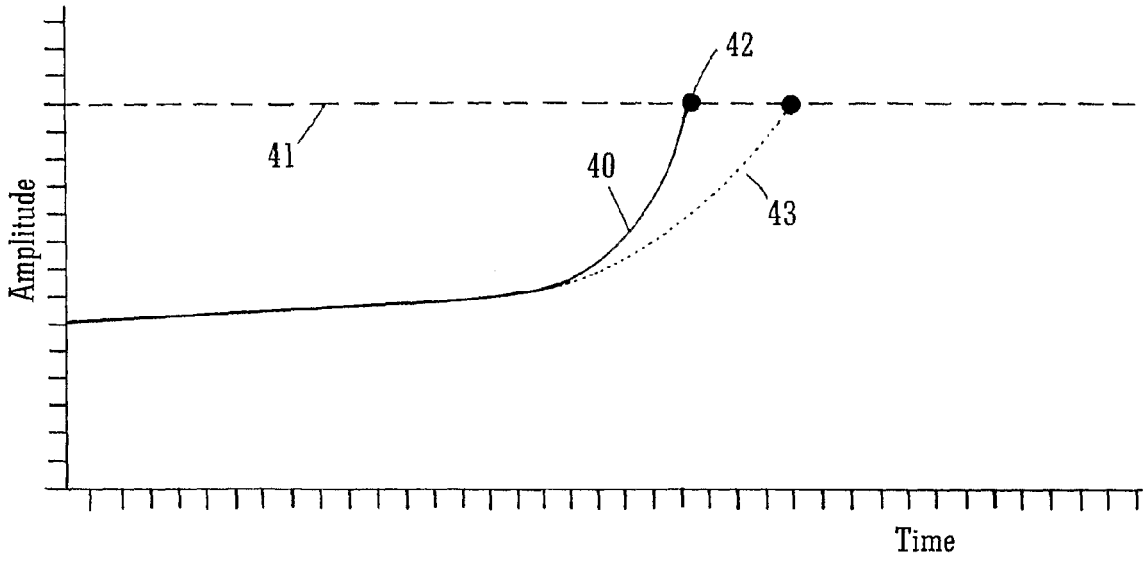
FIG. 16 shows how the amplitude of ion oscillation increases more rapidly with time during a reverse scan according to the second preferred embodiment of the present invention.

FIG. 16 shows a plot of oscillation amplitude 40 versus time for ions having the same mass to charge ratio and under the same analytical scan conditions as described above in relation to FIG. 15. The physical boundary of the preferred ion trap is shown by the dashed line 41 i.e. if ions have an amplitude which exceeds the dashed line 41 then the ions will be ejected from the ion trap 1. Ions will exit the ion trap 1 and can be detected by an ion detector when the amplitude of their oscillation exceeds the dimension of the ion trap at a certain time 42. The effect of the distortion in the electric field from linear across the ends of the ion trap 1 as shown in FIG. 12 is to accelerate the growth in oscillation amplitude compared with the situation with a conventional ion trap wherein the electric field is linear across the whole of the ion trap. The amplitude of ion oscillation and the later ejection of ions from a conventional ion trap is indicated by the dotted line 43. In this case where the resonance frequency ω runs into the AC excitation frequency σ then ions are ejected from the ion trap 1 in a shorter period of time which leads to sharper peaks. Accordingly, the mass resolution is therefore improved for a preferred ion trap 1 operated in a reverse scan mode wherein the electric field across the ends of the preferred ion trap 1 is distorted from a linear electric field as shown in FIG. 12.

It is apparent from the above discussion relating to the first and second preferred embodiments that a different field distortion across the ends of the ion trap 1 is preferably required in order to optimise the performance of the preferred ion trap 1 in a forward scan mode compared with operating the ion trap in a reverse scan mode. Furthermore, it is also apparent that deviations away from an approximately harmonic or quadratic potential at the ends of the ion trap 1 are desirable in order to optimise the performance of the ion trap 1 in either a forward scan or a reverse scan.

The form of the distortion in the electric field away from linear as shown in FIGS. 7 and 12 at the ends of the ion trap 1 is meant only to illustrate the principle of the preferred embodiment. Various other electric field distributions may be applied to the preferred ion trap 1 without deviating from the general principle of the preferred embodiment. In practice, the form of the DC or electrostatic axial potential which enables the performance in forward or reverse scanning mode to be optimised may be empirically determined by adjusting the DC voltages applied to the ion trap 1 thereby controlling the axial DC or electrostatic electric field and observing the peak shape and resolution during an analytical scan.

According to a less preferred embodiment mass selective ejection from the preferred ion trap 1 may be achieved by using a parametric AC excitation waveform as described by Eqn. 23. According to this embodiment the AC excitation waveform may have a frequency a which is equal to 2ω, ω, 0.667ω, 0.5ω, 0.4ω, 0.33ω, 0.28ω or 0.25ω wherein ω is the fundamental or resonance frequency of the ions.

In addition to or as an alternative to modifying the axial DC potentials applied to the ends of the ion trap 1 in order to optimise the performance of the ion trap 1 in either forward or reverse scanning modes further less preferred embodiments are contemplated wherein the conditions for ion ejection may be optimised by adjusting the form of the AC supplemental excitation voltage.

It is noted that the application of an AC excitation waveform along the length of the ion trap which has a non-constant electric field with respect to axial distance will result in a small but nonetheless potentially significant pseudo-potential well.

If the function describing the supplemental or AC excitation waveform is described by the general series expansion:

$$V(t) = \cos(\sigma t) \cdot \sum_{n=1}^{\infty} C_n z^n \tag{24}$$

then the pseudo-potential created by this oscillating inhomogeneous potential is given by:

$$V^*_{(z)} = \frac{q \cdot \left[\sum_{n=1}^{\infty} n C_n z^{n-1}\right]^2}{4m\sigma^2} \tag{25}$$

Although only an approximation, it may be considered that this pseudo-potential adds to the electrostatic potential and may lead to an alteration of the frequency of oscillation of the ions in the z-axis as the amplitude of oscillation increases. This effect may therefore also be used to optimise the performance of the ion trap.

According to the preferred embodiment ions may be introduced into the preferred ion trap 1 from an external ion source either in a pulsed or continuous manner. During the introduction of a continuous beam of ions from an external source the initial axial energy of the ions entering the preferred ion trap may be arranged such that all the ions of a specific mass to charge ratio range are confined by the radial RF field and are trapped by the superimposed axial electrostatic potentials. The electrostatic potential function in the axial direction may or may not be quadratic and its minimum may or may not correspond to the centre of the ion trap 1.

During ion introduction the supplemental AC electric field may have zero amplitude. The initial energy spread of the ions confined or trapped within the preferred ion trap 1 may be reduced by introducing a cooling gas into the ion confinement region of the ion trap 1 at a pressure in the range $10^{-5}$-$10^{1}$ mbar or more preferably in the range $10^{-3}$-$10^{-1}$ mbar. The kinetic energy of the ions will preferably be lost due to collisions with gas molecules and the ions will preferably reach thermal energies. Ions of differing mass to charge ratios may be made to migrate to the point of lowest electrostatic potential along the axis. The spatial and energy spread of the ions may preferably be minimised.

The initial trapping stage may be accomplished in the absence or more preferably in the presence of cooling gas. The initial trapping potentials are not required to follow a quadratic function in the axial direction.

Collisions with residual gas molecules will eventually cause the amplitude of the oscillations to decrease and ions will preferably collapse towards the centre of the axial potential well. However, ions will not be lost as they remain confined by the radial pseudo potential well.

According to the preferred embodiment once ions are cooled to a point corresponding to the minimum of the electrostatic potential well, the shape of the superimposed axial potential may then be set to follow a function, which is deliberately distorted at the ends of the ion trap 1 away from a pure quadratic function in order to optimise the performance of the ion trap under the conditions of the analytical scan to be used. Mass selective ejection of ions from the ion trap 1 may then be accomplished using a forward or reverse scan as previously described.

Ions ejected from the ion trap 1 may be subsequently detected using an ion detector such as a MCP micro channel plate, channeltron or discrete dynode electron multiplier or conversion dynode, phosphor or scintillator and photo multiplier or combinations of these types of detectors.

Ions ejected from the preferred ion trap 1 may be transmitted onwardly to another mass analyser. Alternatively, ions ejected from the preferred ion trap 1 may be transmitted onwardly to a collision gas cell.

Figure 17:
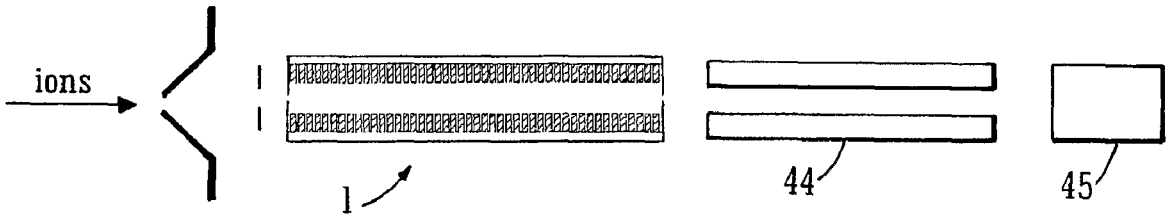
FIG. 17 shows an embodiment wherein a preferred ion trap is provided upstream of a quadrupole rod set mass filter which is scanned in use.

According to an embodiment of the present invention a preferred ion trap 1 may be coupled to a scanning or stepping device such as a quadrupole rod set mass filter or mass analyser in order to improve the overall instrument duty cycle and sensitivity. FIG. 17 shows an embodiment wherein a quadrupole rod set mass filter or mass analyser 44 is provided downstream of a preferred ion trap 1. The output of the preferred ion trap 1 is preferably a function of mass to charge ratio and time. At any given time the mass to charge ratio range of ions exiting the preferred ion trap 1 is preferably relatively restricted. Ions having a particular mass to charge ratio will preferably exit the ion trap 1 over a relatively narrow or short period of time. If the mass to charge ratio transmission window of the scanning quadrupole rod set mass filter or mass analyser 44 is synchronised with the mass to charge ratio range of ions exiting the preferred ion trap 1, then the duty cycle of the scanning quadrupole rod set mass filter or mass analyser 44 is preferably increased.

According to another embodiment the mass to charge ratio transmission window of the quadrupole rod set mass filter or mass analyser 44 may be stepped to a limited number of pre-determined values in a substantially synchronised manner with the ions exiting the preferred ion trap 1. In this way the transmission efficiency and duty cycle of the quadrupole rod set mass filter or mass analyser 2 may be increased for a mode of operation where only ions having specific mass to charge ratios are desired to be measured.

Figure 18:
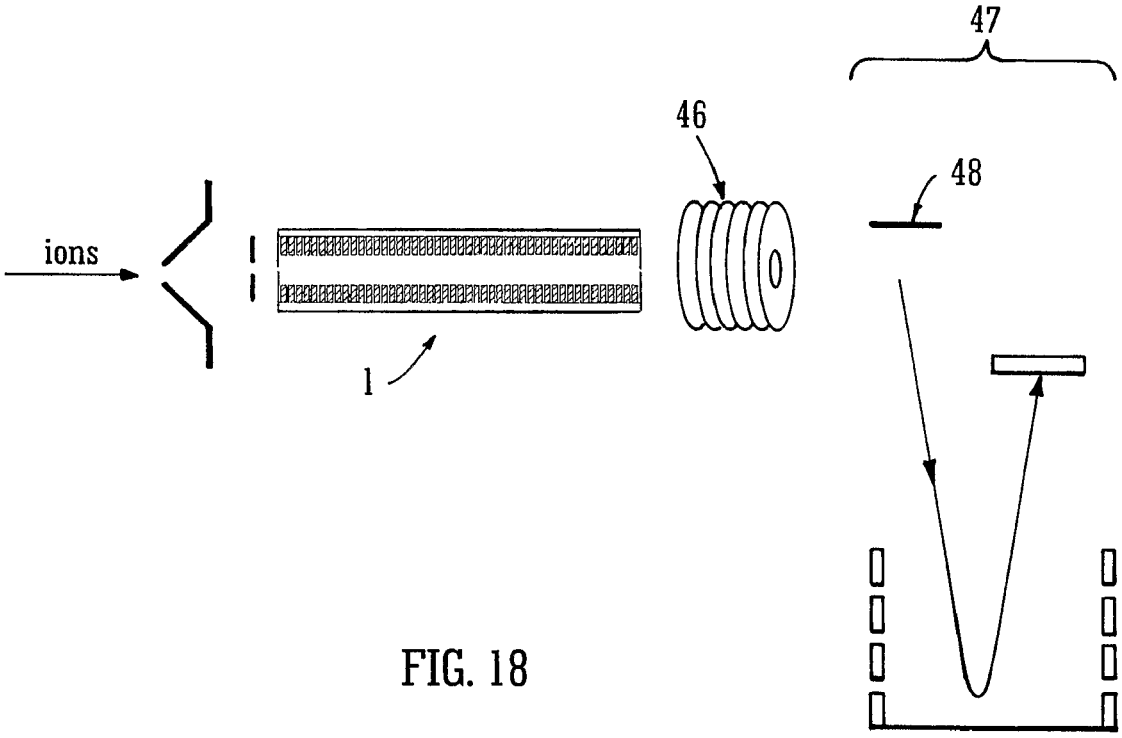
FIG. 18 shows an embodiment wherein a preferred ion trap is interfaced to an orthogonal acceleration Time of Flight mass analyser by an ion guide wherein a plurality of axial potential wells are created within the ion guide which transport or translate ions which emerge from the preferred ion trap to the orthogonal acceleration Time of Flight mass analyser.

FIG. 18 illustrates another embodiment of the present invention wherein a preferred ion trap 1 is coupled to an orthogonal acceleration Time of Flight mass analyser 47 via an ion guide 46. The ion guide 46 is preferably provided downstream of the preferred ion trap 1 and upstream of the orthogonal acceleration Time of Flight mass analyser 47. The ion guide 46 preferably comprises a plurality of electrodes comprising apertures. Ions are preferably arranged to be transmitted in use through the apertures in the electrodes. One or more transient DC voltages or potentials or one or more transient DC voltage or potential waveforms are preferably applied to the electrodes of the ion guide 46 in order to urge, propel, translate or transmit ions received from the preferred ion trap 1 to the orthogonal acceleration Time of Flight mass analyser 47. One or more axial potential wells are preferably created in the ion guide 46 which are then preferably translated along the length of the ion guide 46 so that ions are transmitted from an entrance region of the ion guide 46 to an exit region of the ion guide 46. The ion guide 46 preferably enables the duty cycle and sensitivity of the mass spectrometer to be improved.

The output of the preferred ion trap 1 is preferably mass to charge ratio dependent and time dependent. The ion guide 46 preferably effectively samples the output of ions from the preferred ion trap 1 so that ions within a limited or restricted mass to charge ratio range are trapped in each potential well which is preferably formed in the ion guide 46. The axial potential wells which are created are preferably continually transported or translated along the length of the ion guide 46 until the ions are preferably released from the ion guide 46 and are onwardly transmitted to the orthogonal acceleration Time of Flight mass analyser 47. An orthogonal acceleration extraction pulse is preferably synchronised with the release of ions from the ion guide 46 so as to maximise the transmission of ions within a given well/packet into the orthogonal acceleration Time of Flight mass analyser 47.

Further embodiments of the present invention are contemplated wherein a combination of resonance excitation at the fundamental harmonic frequency and parametric instability may be used in order to effect mass selective ejection of ions from the preferred ion trap 1.

In addition to a MS mode of operation the preferred ion trap 1 may also be used to perform $MS^n$ experiments. According to an embodiment, for example, parent or precursor ions may be induced to fragment. The fragment or product ions may then be mass analysed. Alternatively, first generation fragment or product ions may be further induced to fragment into second generation fragment or product ions. The second generation fragment or product ions may then be mass analysed.

Parent or precursor ions may be selected external to the preferred ion trap 1 by a mass filter. Ions may be induced to fragment in a fragmentation cell external to the preferred ion trap 1. Alternatively, the ions may be induced to fragment within the preferred ion trap 1.

According to an embodiment parent or precursor ions having a particular mass to charge ratio may be selected within the ion trap 1 using the well-known radial stability characteristics of a RF quadrupole. A dipolar or quadrupolar excitation voltage or a resolving DC voltage may be applied to the electrodes comprising the ion trap 1 in order to reject certain ions having particular mass to charge ratios either as ions enter the preferred ion trap 1 or once ions are trapped within the preferred ion trap 1.

According to another embodiment parent or precursor ion selection may be accomplished using axial resonance or axial parametric excitation to effect ejection of ions from the axial electrostatic or DC potential well. In this case a broad band of excitation frequencies may be applied simultaneously to the axial DC voltage. All ions with the exception of certain parent or precursor which are desired to be retained within the ion trap 1 are preferably ejected. The method of inverse Fourier transform may be employed to generate a suitable superimposed waveform for resonance ejection of a broad range of ions whilst leaving specific ions trapped within the preferred ion trap 1.

According to another embodiment parent or precursor selection may be accomplished using a combination of axial resonance ejection and mass selective parametric instability to eject ions from the axial electrostatic or DC potential well.

According to an embodiment collision gas may be introduced into the preferred ion trap 1. Selected parent or precursor ions may then be caused to fragment by increasing the amplitude of oscillation and therefore the velocity of the ions in the axial direction using resonance excitation and/or parametric excitation. Alternatively, ions may be caused to fragment by increasing the amplitude of oscillation and therefore the velocity of the ions in the radial direction by altering the frequency or amplitude of the RF voltage applied to the electrodes of the ion trap 1 or by superimposing a suitable dipolar or quadrupolar AC excitation waveform to one pair of the segmented quadrupole rods. A combination of the techniques above may be used to excite selected ions to possess sufficient energy such that the ions are then caused to fragment. The resulting fragment or daughter ions may be mass analysed by any of the methods described above.

The process of selecting certain ions and exciting or ejecting certain ions may be repeated thereby allowing $MS^n$ experiments to be performed. The resultant $MS^n$ ions produced may be axially ejected using the methods described above.

According to a preferred embodiment the ion trap 1 preferably comprises an axially segmented quadrupole rod set assembly. The individual axial segments of each pair of the rods 2*a*,2*b* are preferably semi-circular in cross section. The axial segments are preferably attached to an electrically insulating block 3 which preferably ensures that the axial segments are positioned correctly with respect to each other and with respect to the other rods.

According to a preferred embodiment each axial segment may be 3 mm long and the axial segments may be arranged with a 1 mm spacing between each axial segment. A desired voltage may be applied to each axial segment by applying the voltage to an appropriate pin 4 which preferably runs through the insulating block 3.

The radius $r_0$ of the inscribed circle formed by the four rods 2*a*,2*b* may preferably be 5.32 mm. The rods may preferably have a radius $r_1$ of 6 mm. The whole ion trap assembly may according to one embodiment comprise 46 axial segments. The ion trap may be bounded at each end by two 0.5 mm thick plates. The two plates may each have a hole which is preferably 2 mm in diameter. The holes in the two plates may preferably be positioned along the central axis of the ion trap 1. A gas inlet line 5 preferably passes through one of the insulting blocks 3 to allow the introduction of a buffer gas such as Helium into the preferred ion trap 1.

Figure 19:
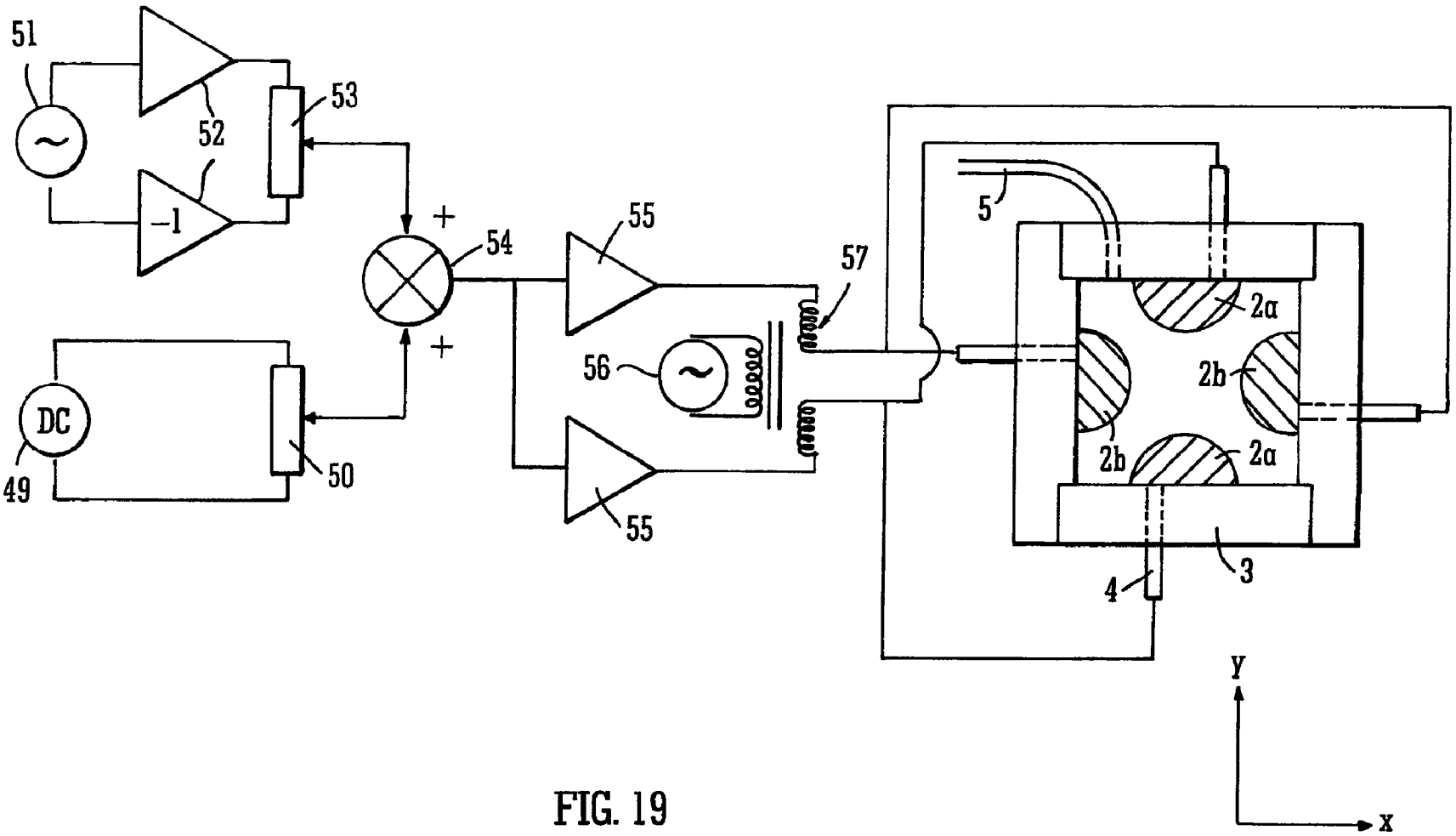
FIG. 19 shows details of the DC, AC and RF power supplies which are used to apply DC, AC and RF voltages to each axial segment of a preferred ion trap.

FIG. 19 shows a schematic of the electrical connections to an individual axial segment of the preferred ion trap 1. The components shown are duplicated for each individual axial segment apart from the power supplies 49,51 and the inverting amplifier 52. DC supply 49 preferably provides a DC potential or voltage to the axial segment. The DC potential of each axial segment may be adjusted by a variable resistor 50. A separate variable resistor is preferably provided for each axial segment of the preferred ion trap 1 thereby allowing any static or DC potential function to be applied along the length of the preferred ion trap 1.

A supplemental alternating current supply 51 is preferably used to provide a signal which excites ions within the preferred ion trap 1. The alternating current signal is preferably fed into two unity gain amplifiers 52. One of the unity gain amplifiers is preferably inverting. The combined output of the two amplifiers may be adjusted using a variable resistor 53. The embodiment shown in FIG. 19 allows the AC signal applied to individual axial segments of the preferred ion trap 1 to be adjusted in terms of peak-to-peak amplitude and for the phase of the waveform to be changed by 180 degrees. A separate variable resistor is preferably provided for each axial segment of the preferred ion trap 1. The output of the variable resistors 50,53 is preferably fed into an adding circuit 54. The combined DC and AC signals for an individual axial segment are then preferably fed into two amplifiers 55. A second AC voltage at RF frequency is preferably added to this signal via an RF power supply 56 and transformer 57. The second AC signal at RF frequency is preferably common to all the axial segments of the preferred ion trap and preferably causes an pseudo-potential to be created which preferably confines ions radially within the ion trap 1. Two outputs are produced which differ only in the phase of the radial confining RF voltage 56. Considering pairs of segments 2*a*,2*b* which are in the same x,y plane the two outputs are attached to opposing pairs of electrodes 2*a*,2*b*. Thus electrodes 2*a* will have the same static DC potential and supplemental AC excitation potential as electrodes 2*b* but the phase of the radial trapping RF potential will be 180 degrees different than that applied to electrodes 26.

The ion trap 1 preferably comprises an entrance aperture plate 15 and an exit aperture plate 16 as shown in FIG. 2. The entrance aperture plate 15 and the exit aperture plate 16 are preferably connected to separate DC supplies.

Figure 20:
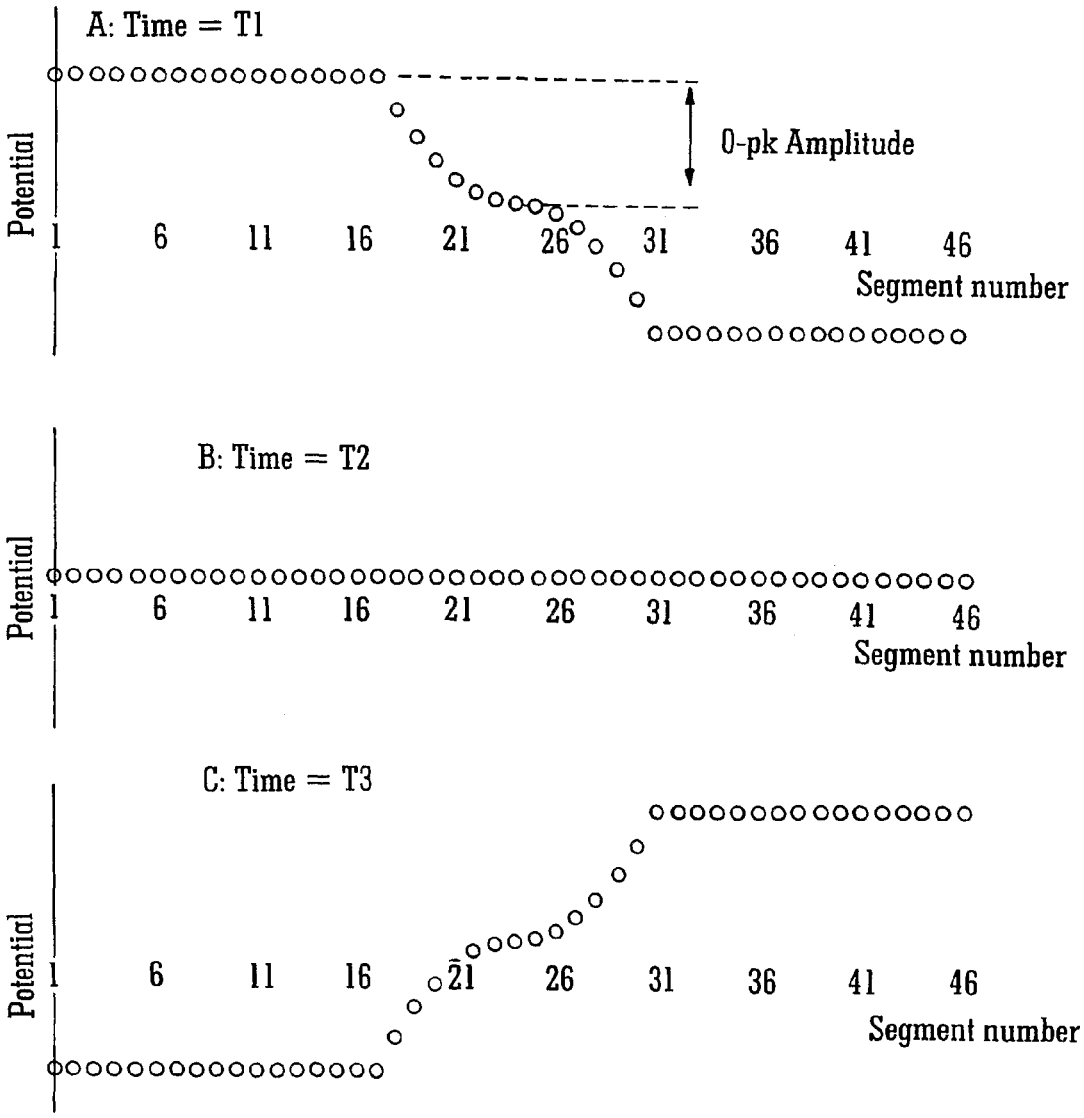
FIG. 20A shows the form of a supplemental AC potential as applied to the electrodes of a preferred ion trap at a time T1.
FIG. 20B shows the form of a supplemental AC potential as applied to the electrodes of a preferred ion trap at a time T2 and FIG. 20C shows the form of a supplemental AC potential as applied to the electrodes of a preferred ion trap at a time T3.

A supplemental AC excitation waveform was generated using an external sweep function generator and sinusoidal modulation was used in order to produce some experimental results. FIGS. 20A-20C shows the form of an excitation waveform which was used for resonance ejection at times T1, T2 and T3. FIG. 20A shows the AC excitation potential at time T1 at which point the waveform from the external supply reaches maximum amplitude. FIG. 20B shows the AC excitation potential at time T2 at which point the waveform from the external supply reaches zero amplitude. FIG. 20C shows the AC excitation potential at time T3 at which point the waveform from the external supply reaches a maximum amplitude of the opposite polarity to that shown in FIG. 20A. The angular frequency of oscillation of the AC excitation waveform is given by:

$$\sigma = \frac{\pi}{(T3 - T1)} \tag{26}$$

The general form of the AC excitation voltage is given by:

$$V(t) = \left(\frac{z}{|z|}\right) z^2 \cos(\sigma t) \tag{27}$$

wherein z is the axial displacement from the centre of the electrostatic well shown in FIG. 2. This waveform was chosen to emulate the conditions for dipole excitation in a Paul or 3D ion trap.

Figure 21:
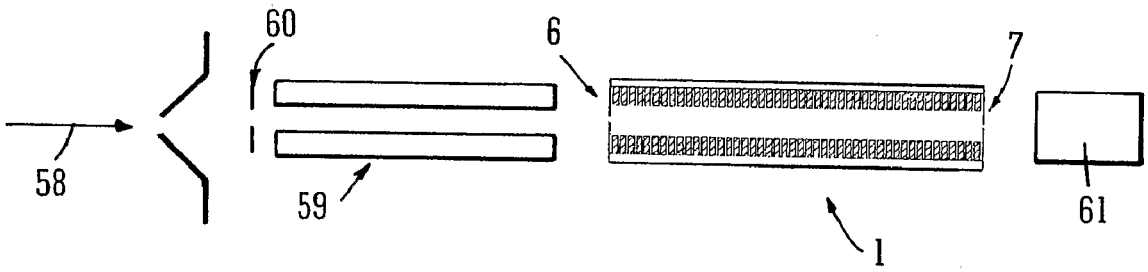
FIG. 21 shows another embodiment of the present invention wherein a preferred ion trap is provided downstream of a quadrupole rod set mass filter.

FIG. 21 shows an embodiment of the present invention which was used to produce some experimental results. Positive ions 58 were produced using an Electrospray ionisation source. The ions 58 from the ion source were passed through a conventional quadrupole mass filter 59. Ions were then introduced into an ion trap 1 according to the preferred embodiment along the axis of the ion trap 1. Ions having specific mass to charge ratios were introduced into the preferred ion trap 1 during a filling up period. Throughout the experiment the RF voltage applied to the segmented rods of the preferred ion trap 1 in order to cause ions to be confined radially within the ion trap 1 was set to an amplitude of 130 V (0-peak). The frequency of the RF voltage was $6.3\times10^6$ rad/sec. Helium buffer gas was introduced into the preferred ion trap 1 in order to maintain an analyser pressure external to the ion trap of $8\times10^{-6}$ mbar. The entrance plate voltage 6 was set to −3 V.

For the following spectra shown in FIGS. 22 and 23 which will be discussed in more detail below, the axial static or DC trapping potential was programmed as shown in FIG. 2. This function was found empirically to be the optimum for reverse scans. The axial potential of the electrodes was first set to follow a substantially quadratic function (as shown by the dotted line in FIG. 2). The DC voltages of electrode segments 17 and 31 were then adjusted in a manner according to the preferred embodiment in order to optimise the peak shape of the signal observed when scanning the AC excitation frequency during a reverse scan in which ions having relatively high mass to charge ratios were ejected from the ion trap before ions having relatively low mass to charge ratios. Segments 17 and 31 were maintained at −0.5 V rather than −3.0 V.

A mixture of Polyethylene Glycol and Sulphadimethoxine was introduced via an Electrospray ion source. The quadrupole mass filter 59 as shown in FIG. 21 upstream of the preferred ion trap 1 was set to transmit ions having mass to charge ratios in the range 296-316. The exit plate 7 was maintained at a potential of +6 V. After a period of approximately 0.5 s to allow filling of the preferred ion trap 1 with ions, the ion beam was stopped from reaching the ion trap 1 by raising the potential on the aperture plate 60. The potential on the exit plate 7 was then lowered to −6 V prior to scanning the frequency of the supplemental AC excitation voltage waveform.

The frequency of the supplemental AC excitation voltage waveform was then scanned from approximately 2500 Hz to 25000 Hz at a rate of approximately 5000 Hz per second with a maximum amplitude of 2V using the function shown and described above in relation to FIG. 20. Ions ejected from the exit of the ion trap 1 were recorded using a photomultiplier detector 61 and an analogue to digital recorder as the frequency of the supplemental AC excitation voltage waveform was swept.

Figure 22:
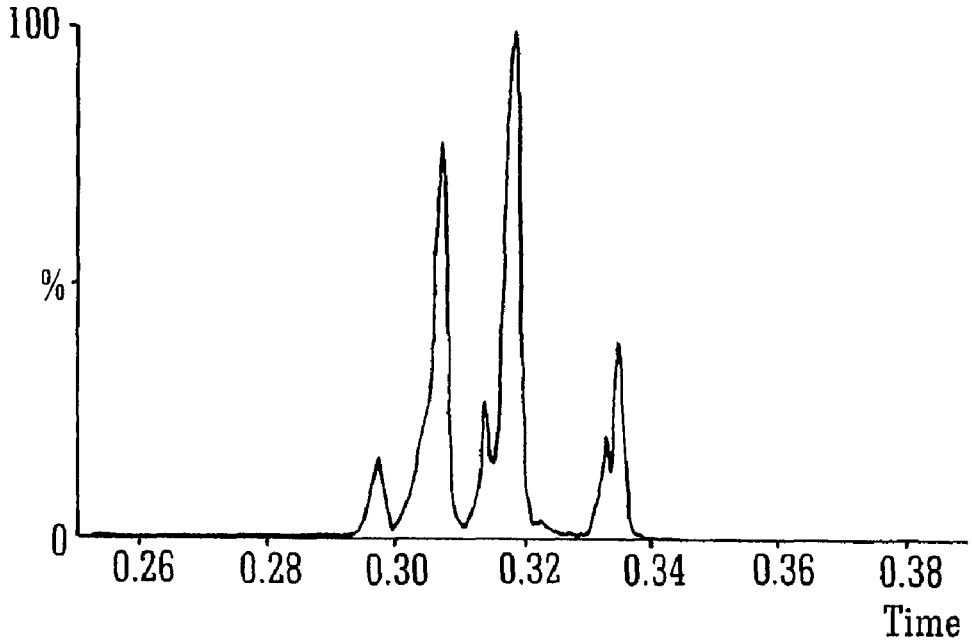
FIG. 22 shows the signal amplitude as a function of time recorded by an ion detector when a reverse scan of an ion trap was performed according to a preferred embodiment of the present invention.
Figure 23:
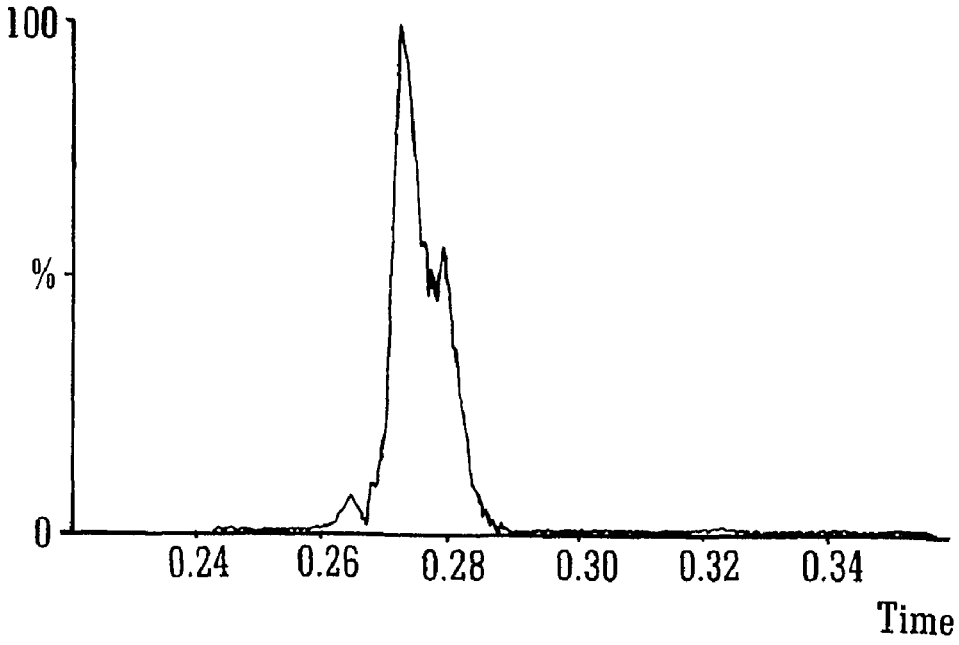
FIG. 23 shows the corresponding signal amplitude as a function of time recorded by an ion detector when a forward scan of an ion trap was performed according to a less preferred embodiment of the present invention.

FIG. 22 shows the signal recorded by the ion detector as a function of time for the excitation experiment described above. The two most intense peaks which can be observed in FIG. 22 correspond to the $(M+H)^+$ ion of Suphadimethoxine $(C_{12}H_1N_4O_4S)^+$ having a mass to charge ratio 311 and ions having a mass to charge ratio of 305 which correspond to the sodium adduct of polyethylene glycol $(C_2H_4O)_6+H_2O+Na)^+$. The ion trap 1 was operated in a reverse scan mode wherein ions having relatively high mass to charge ratios were arranged to exit the ion trap before ions having relatively low mass to charge ratios. Ions were ejected from the ion trap 1 when the supplemental AC voltage had a frequency of approximately 13,000 Hz. The measured mass resolution was approximately 350 FWHM.

The same experiment was then repeated and the preferred ion trap 1 was operated in a forward scan mode of operation. The frequency of the supplemental excitation waveform was scanned from approximately 25000 Hz to 2500 Hz at a rate of approximately 5000 Hz per second with a maximum amplitude of 2V using the function shown and described above in relation to FIG. 20. The resulting spectrum produced is shown in FIG. 23. In this mode of operation ions having relatively low mass to charge ratios were ejected from the ion trap 1 before ions having relatively high mass to charge ratios. It is apparent from comparing FIGS. 22 and 23 that there is a difference in the resolution and peak shape observed using a forward scan compared to a reverse scan.

Figure 24:
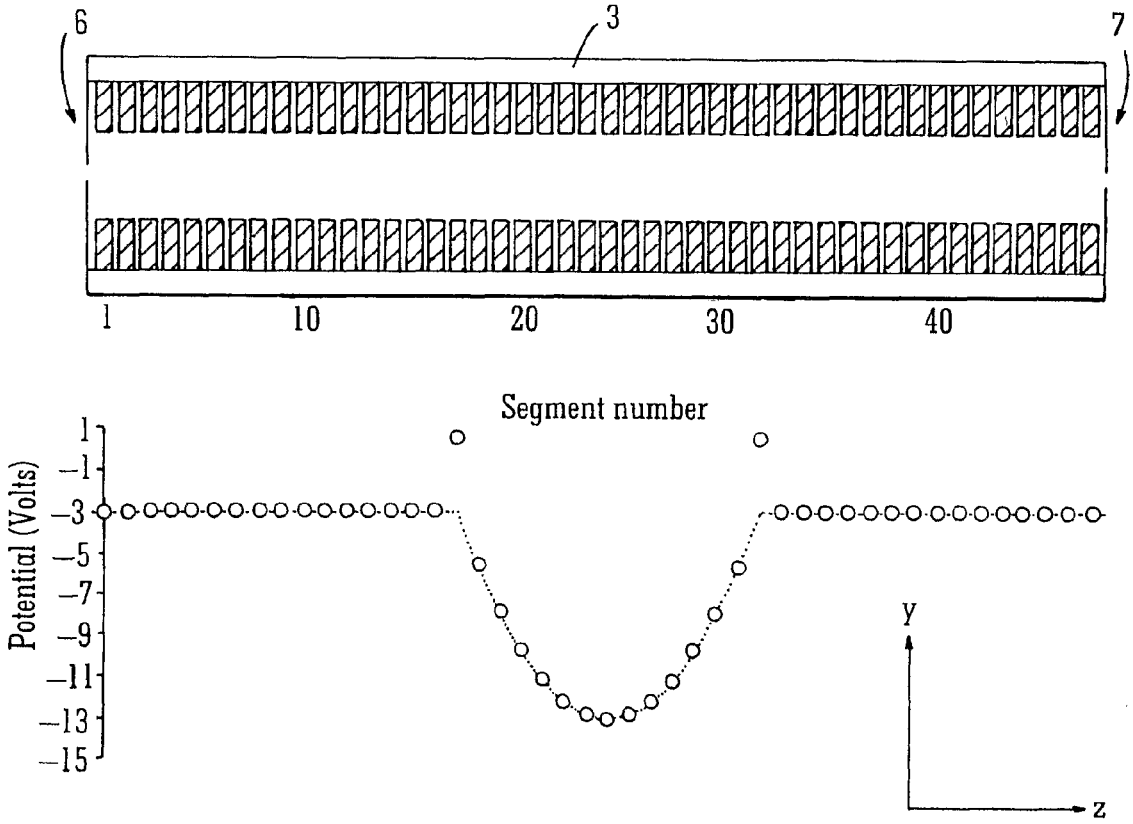
FIG. 24 shows a preferred ion trap in the z,y plane together with a plot of the potential applied to each axial segment according to a mode of operation.

The axial static trapping potential was then programmed as shown in FIG. 24. This function was found empirically to optimise the performance of the ion trap 1 in a forward scan. The axial potential applied to the electrodes was first set to follow a substantially quadratic function (as shown by the dotted line in FIG. 24). The DC voltages of electrode segments 17 and 31 were then adjusted to optimise the peak shape and resolution of the signal observed when scanning the AC excitation frequency for a forward scan in which relatively low mass to charge ratio ions are ejected before relatively high mass to charge ratio ions. The optimised potential of segments 17 and 31 was +0.5 V. Experiments were then carried out using the same frequency scan as described above.

Figure 25:
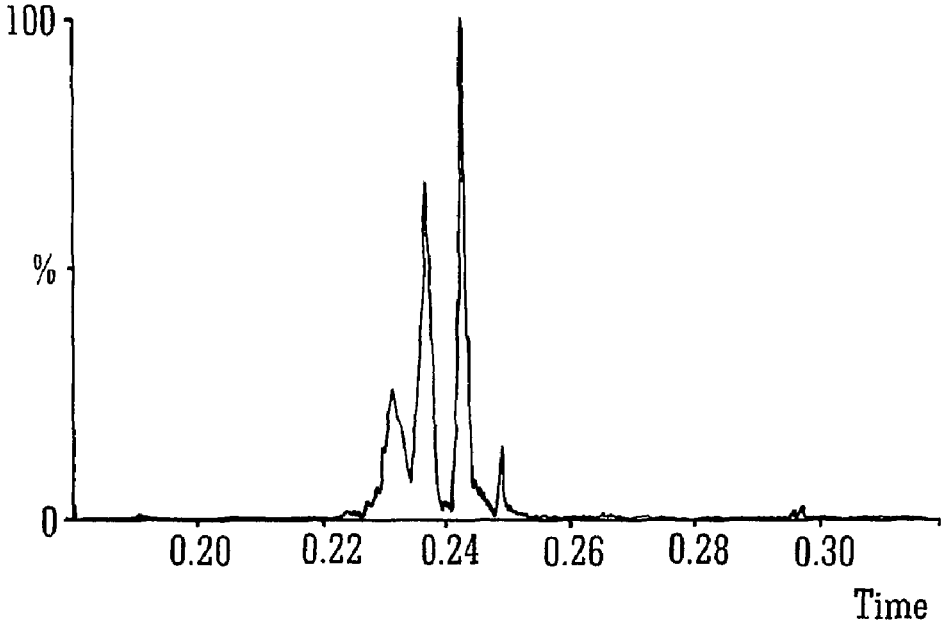
FIG. 25 shows the signal amplitude as a function of time recorded by an ion detector when a forward scan of an ion trap was performed according to a preferred embodiment of the present invention.

FIG. 25 shows the spectrum which was obtained using a forward scan in which ions of relatively low mass to charge ratio are ejected from the ion trap 1 before ions of relatively high mass to charge ratio value. The mass resolution obtained is approximately 320 FWHM. This represents a significant improvement in performance compared to the data shown in FIG. 23. FIG. 23 shows data obtained using the same analytical scan as that used to generate the data shown in FIG. 25 but with an axial electrostatic potential as shown in FIG. 2.

Figure 26:
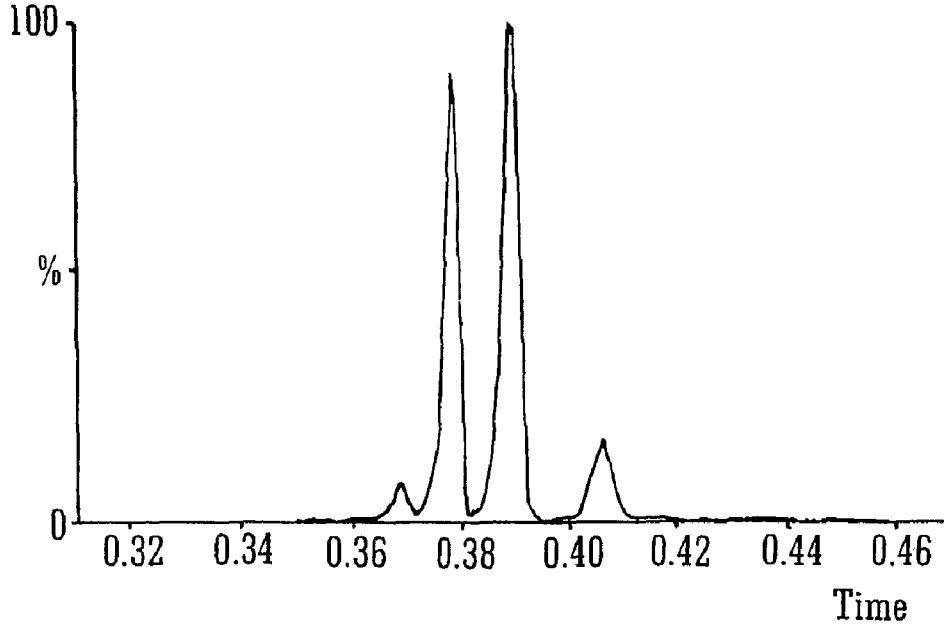
FIG. 26 shows the signal amplitude as a function of time recorded by an ion detector when a reverse scan of an ion trap was performed according to a less preferred embodiment of the present invention.

FIG. 26 shows the spectrum obtained using a reverse scan in which ions of relatively high mass to charge ratio value are ejected from the ion trap 1 before ions of relatively high mass to charge ratio value. The mass resolution obtained is approximately 120 FWHM. This represents a degrading of performance compared to the data shown in FIG. 22. FIG. 22 shows data from the same analytical scan as that used to generate the data shown in FIG. 26 but with an axial electrostatic potential as shown in FIG. 2.

It can be seen in this case that the peak shape and resolution is superior in the case of the forward scan compared to that obtained using a reverse scan. The data demonstrates the importance of the shape of the non-linear axial field program which is used to optimise the performance depending on the direction of the analytical scan.

It is clear that further optimisation is possible by careful adjustment of the voltages applied to the other elements defining the axial field or by adjusting the field within the ion trap using external electrodes.

According to other embodiments a monopole, hexapole, octapole or higher order multi-pole device may be utilised for radial confinement of ions. Higher order multi-poles have a higher order pseudo-potential well function. In addition the base of the pseudo potential well is broader thus the ion trap may have a higher capacity for charge improving the overall dynamic range. In addition the higher order radial fields within non-quadrupolar devices reduce the likelihood of radial resonance losses. In non-linear radial fields the frequency of the radial secular motion is related to position of the radial ions therefore ions will go out of resonance before they are ejected.

For all multi-poles either hyperbolic or circular or square cross section rods may be utilised. Other shapes may also be used.

According to another embodiment the axial DC potential may be developed using continuous rods rather than segmented rods. In this case the rods may be non-conducting and may be coated with a non-uniform resistive material such that application of voltage between the centre of the rods and the ends of the rods results in an axial potential well within the ion trap.

According to another embodiment the desired axial DC, potential may be developed by placing a segmented, resistively coated, or suitably shaped electrode around the outside of a multi pole ion trap. Application of a suitable voltage to this may result in a required potential within the ion confinement region of the RF multi pole.

According to another embodiment a RF ring stack with circular or non circular apertures (ion tunnel) with a superimposed axial potential functions may be utilised. In this embodiment RF voltages of alternating polarity are preferably applied to the adjacent annular rings of the ion tunnel ion trap. This provides confinement of ions in the radial direction.

According to another embodiment radial confinement may be achieved using an ion trap comprising two stacks of plates arranged either side of the ion trajectory with opposite phases of RF being applied to adjacent plates. Plates arranged at the top and bottom of two such stacks of plates are preferably used to effect a confined ion trapping volume. These confining plates may be segmented to allow an axial trapping electrostatic potential function to be superimposed and mass selective axial ejection may be performed using the methods described above.

In addition to the embodiments above, further embodiments of the present invention are contemplated wherein multiple axial DC potential wells are provided. By manipulating the superimposed DC applied to the electrode segments, ions may be trapped in specific axial regions. Ions trapped within a DC potential well in a specific region of the ion trap may be subjected to mass selective ejection causing one or more ions to leave that potential well. The ions which are ejected may be subsequently trapped in a separate potential well within the same ion trap. This type of operation may be utilised, for example, to study ion-ion interactions. In this mode ions may be introduced from either or both ends of the ion trap simultaneously.

Alternatively, ions trapped in a first potential well may be subjected to mass selective ejection which causes only ions having a specific mass to charge ratio or ions having a ratio within a particular mass to charge range to leave the first well and enter a second potential well. Mass selective excitation may be performed in the second well to fragment these ions. The fragment or daughter ions may then be sequentially ejected from this potential well for axial detection. Repeating this process of MS/MS of all the ions within the first potential well may be recorded with substantially 100% efficiency.

It is possible to produce more than two potential wells within the ion trap allowing complex experiments to be realised. Alternatively, this flexibility may be used to condition the characteristics of ion packets for introduction to other analysis techniques.

Although the present invention has been described with reference to the preferred embodiments, it will be understood by those skilled in the art that various changes in form and detail may be made without departing from the scope of the invention as set forth in the accompanying claims.

The invention claimed is:

1. An ion guide or ion trap comprising:

a plurality of electrodes;

an AC or RF voltage supply arranged and adapted to apply an AC or RF voltage to at least some of said plurality of electrodes in order to confine at least some ions radially within said ion guide or ion trap;

a DC voltage supply arranged and adapted to maintain a DC or electrostatic electric field across at least a portion of the axial length of said ion guide or ion trap in order to confine at least some ions axially within an axial ion trapping region of said ion guide or ion trap, wherein said DC or electrostatic electric field is substantially linear across a first portion of said axial ion trapping region and is substantially non-linear across one or more second portions of said axial ion trapping region; and a supplemental AC voltage supply arranged and adapted to apply a supplemental AC voltage or potential to said electrodes in a first mode of operation in order to resonantly or parametrically eject at least some ions axially from said ion guide or ion trap.

2. An ion guide or ion trap as claimed in claim 1, wherein said ion trap or ion guide comprises a linear ion trap or ion guide.

3. An ion guide or ion trap as claimed in claim 1, wherein said DC voltage supply is arranged and adapted to create a DC, real or static potential well having a minimum located at a first position along the axial length of said ion guide or ion trap.

4. An ion guide or ion trap as claimed in claim 1, wherein said first portion extends across a middle or central section of said axial ion trapping region and wherein said one or more second portions extend across one or both ends of said axial ion trapping region.

5. An ion guide or ion trap as claimed in claim 1, wherein the substantially linear DC or electrostatic field arranges a substantially quadratic DC potential across said first portion of the axial trapping region.

6. An ion guide or ion trap as claimed in claim 1, wherein said DC voltage supply comprises one or more DC voltage supplies for supplying one or more DC voltages to at least 1%, 5%, 10%, 20%, 30%, 40%, 50%, 60%, 70%, 80%, 90%, 95% or 100% of said electrodes.

7. An ion guide or ion trap as claimed in claim 1, further comprising means arranged and adapted to vary or scan the amplitude of said supplemental AC voltage or potential.

8. An ion guide or ion trap as claimed in claim 7, wherein said means is arranged and adapted to increase or decrease the amplitude of said supplemental AC voltage or potential.

9. An ion guide or ion trap as claimed in claim 1, further comprising means arranged and adapted to vary or scan the frequency of oscillation or modulation of said supplemental AC voltage or potential.

10. An ion guide or ion trap as claimed in claim 9, wherein said means is arranged and adapted to increase or decrease the frequency of oscillation or modulation of said supplemental AC voltage or potential.

11. An ion guide or ion trap as claimed in claim 1, further comprising means arranged and adapted to vary or scan the amplitude or depth of one or more DC, real or static potential wells.

12. An ion guide or ion trap as claimed in claim 11, wherein said means is arranged and adapted to increase or decrease the amplitude or depth of said one or more DC, real or static potential wells.

13. An ion guide or ion trap as claimed in claim 1, wherein said ion guide or ion trap is segmented axially so as to comprise a plurality of axial segments.

14. An ion guide or ion trap as claimed in claim 1, wherein said ion guide or ion trap comprises 1, 2, 3, 4, 5, 6, 7, 8, 9, 10 or >10 electrodes or comprises at least: (i) 10-20 electrodes; (ii) 20-30 electrodes; (iii) 30-40 electrodes; (iv) 40-50 electrodes; (v) 50-60 electrodes; (vi) 60-70 electrodes; (vii) 70-80 electrodes; (viii) 80-90 electrodes; (ix) 90-100 electrodes; (x) 100-110 electrodes; (xi) 110-120 electrodes; (xii) 120-130 electrodes; (xiii) 130-140 electrodes; (xiv) 14.0-150 electrodes; or (xv) >150 electrodes.

15. A mass spectrometer comprising an ion guide or an ion trap as claimed in claim 1.

16. A mass spectrometer as claimed in claim 15, further comprising a mass filter or mass analyser arranged upstream or downstream of said ion guide or ion trap.

17. A mass spectrometer as claimed in claim 16, wherein in a mode of operation said mass filter or mass analyser is scanned or a mass to charge ratio transmission window of said mass filter or mass analyser is varied with time in synchronism with the operation of said ion guide or ion trap or with the mass to charge ratio of ions emerging from or being transmitted to said ion guide or ion trap.

18. A method of guiding or trapping ions comprising:

providing a plurality of electrodes;

applying an AC or RF voltage to at least some of said plurality of electrodes in order to confine at least some ions radially within said ion guide or ion trap;

maintaining a DC or electrostatic electric field across at least a portion of an axial length of said ion guide or ion trap in order to confine at least some ions axially within an axial ion trapping region of said ion guide or ion trap, wherein said DC or electrostatic electric field is substantially linear across a first portion of said axial ion trapping region and is substantially non-linear across one or more second portions of said axial ion trapping region; and applying a supplemental AC voltage or potential to at least some of said plurality of electrodes in a first mode of operation in order to resonantly or parametrically eject at least some ions axially from said ion guide or ion trap.

19. A method of mass spectrometry comprising the method as claimed in claim 18.

* * * * *